US008851394B2

(12) United States Patent
Ikegami et al.

(10) Patent No.: US 8,851,394 B2
(45) Date of Patent: Oct. 7, 2014

(54) EXPANSION VALVE AND METHOD OF PRODUCING THE SAME

(75) Inventors: Makoto Ikegami, Kariya (JP); Kenichi Fujiwara, Kariya (JP)

(73) Assignee: Denso Corporation, Kariya (JP)

( * ) Notice: Subject to any disclaimer, the term of this patent is extended or adjusted under 35 U.S.C. 154(b) by 1309 days.

(21) Appl. No.: 12/592,670

(22) Filed: Dec. 1, 2009

(65) Prior Publication Data

US 2010/0163637 A1 Jul. 1, 2010

(30) Foreign Application Priority Data

Dec. 2, 2008 (JP) ..... 2008-307807
Mar. 27, 2009 (JP) ..... 2009-079118

(51) Int. Cl.
*F25B 41/04* (2006.01)
*F25B 41/06* (2006.01)

(52) U.S. Cl.
CPC ..... *F25B 41/062* (2013.01); *F25B 2500/31* (2013.01); *F25B 41/06* (2013.01); *F25B 2500/15* (2013.01)
USPC ..... 236/92 B

(58) Field of Classification Search
USPC ..... 62/210, 222, 528; 236/92 B
See application file for complete search history.

(56) References Cited

U.S. PATENT DOCUMENTS 4,979,372 A * 12/1990 Tanaka ..... 62/225
5,675,982 A * 10/1997 Kirol et al. ..... 62/225
6,223,994 B1 5/2001 Fukuda et al.
6,467,290 B2 10/2002 Minowa et al.
6,540,149 B1 4/2003 Yano et al.

FOREIGN PATENT DOCUMENTS

JP 09-159324 6/1997
JP 2001-033123 2/2001
JP 2002-054861 2/2002

OTHER PUBLICATIONS

Office action dated Apr. 29, 2011 in corresponding Chinese Application No. 2009 10252325.8.
(Second) Office Action dated May 15, 2012 in corresponding Chinese Application No. 200910252325.8 (with English translation).

* cited by examiner

*Primary Examiner* — Mohammad M Ali
*Assistant Examiner* — Daniel C Comings
(74) *Attorney, Agent, or Firm* — Harness, Dickey & Pierce, PLC

(57) ABSTRACT

An expansion valve to expand high-pressure refrigerant and send the expanded refrigerant toward an evaporator is used in a refrigeration cycle, and includes a body portion, an element portion, and a valve portion. The body portion has a first passage through which the high-pressure refrigerant passes, a throttle passage located in the first passage so as to expand refrigerant, and a second passage through which refrigerant flowing out of the evaporator passes. The element portion arranged outside of the body portion has a pressure responding member to be displaced in accordance with a difference between an inner pressure of a seal space and a pressure of refrigerant flowing through the second passage. Temperature sensing media is filled in the seal space, and a pressure of the media is changed by temperature. The valve portion is displaced in accordance with the pressure responding member so as to control an opening of the throttle passage. Additive is filled in the seal space with the media so as to lower a condensing temperature of the media.

19 Claims, 11 Drawing Sheets

EXPANSION VALVE AND METHOD OF PRODUCING THE SAME

CROSS REFERENCE TO RELATED APPLICATION

This application is based on Japanese Patent Application No. 2008-307807 filed on Dec. 2, 2008, and Japanese Patent Application No. 2009-79118 filed on Mar. 27, 2009, the disclosures of which are incorporated herein by reference in their entirety.

BACKGROUND OF THE INVENTION

The present invention relates to an expansion valve used in a refrigeration cycle such as an air-conditioning apparatus or a refrigeration apparatus, and a method of producing the expansion valve.

A thermal expansion valve is used in a vapor-compressing refrigeration cycle. The thermal expansion valve decompresses and expands high-pressure refrigerant in a manner that a superheat degree of refrigerant flowing out of an evaporator becomes close to a predetermined value. This kind of expansion valve includes an element portion to be displaced in accordance with a temperature and a pressure of refrigerant flowing out of the evaporator. A valve portion is displaced by the displacement of the element portion, such that an opening degree of a throttle passage to decompress and expand high-pressure refrigerant is controlled.

Specifically, the element portion includes a diaphragm corresponding to a pressure-responding part, which is displaced in accordance with a pressure difference. The pressure difference is defined between an inner pressure of a seal space filled with a temperature sensing media and a pressure of refrigerant flowing out of the evaporator. A pressure of the media is varied in accordance with the temperature. The displacement of the diaphragm is transmitted to the valve portion through a temperature sensing bar. The bar transmits a temperature of refrigerant flowing out of the evaporator to the media.

Thus, the pressure of media filled in the seal space corresponds to the temperature of refrigerant flowing out of the evaporator. The diaphragm is displaced based on the pressure difference between the inner pressure of the seal space and the pressure of refrigerant flowing out of the evaporator. JP-B2-3995828 discloses an expansion valve, in which an opening degree of a throttle passage is controlled by displacing a valve portion. The valve portion is displaced by a displacement of a diaphragm in accordance with a temperature and a pressure of refrigerant flowing out of an evaporator.

This kind of thermal expansion valve typically includes a body portion to form an outer frame, and the body portion has a refrigerant passage through which high-pressure refrigerant passes, a throttle passage to decompress and expand the high-pressure refrigerant, and another refrigerant passage through which refrigerant flowing out of an evaporator passes. Further, a temperature sensing bar and a valve portion are arranged inside of the body portion, and an element portion is arranged outside of the body portion.

Therefore, when outside air temperature is low in winter, temperature sensing media filled in a seal space of the element portion condenses. That is, the media is in an overcooled liquid state.

In this case, because the seal space is difficult to have a pressure variation, the pressure of the seal space cannot correspond to the temperature of refrigerant flowing out of the evaporator. As a result, malfunction may be generated, because the valve portion cannot properly control the opening degree of the throttle passage.

JP-A-H09-159324 discloses a gas-charged expansion valve as a decompressing device of a refrigeration cycle. Gas phase temperature sensing media is filled in a temperature sensing portion of the expansion valve. Resin having low heat conductivity is inserted around an outer circumference of a temperature sensing bar. The bar is made of aluminum, and corresponds to a stem defining a valve driving bar. The resin is tightly integrated with the temperature sensing bar, and may be made of PPS resin, for example, having no over-time change generated by refrigerant.

A part of the temperature sensing bar is exposed to a low-pressure refrigerant passage through which gas phase refrigerant of a refrigeration cycle passes, and the resin in arranged on the exposed part. A temperature of vapor refrigerant flowing through the low-pressure refrigerant passage out of the evaporator is transmitted to refrigerant filled in an upper pressure-responding chamber of a power element as a temperature sensing fluid. Thus, operating gas having a pressure corresponding to the transmitted temperature is generated. Therefore, even when non-vapor low-pressure refrigerant flows out of the evaporator into the low-pressure refrigerant passage and adheres on the resin, a time constant of heat transmission becomes large, because the resin has the low heat conductivity. Thus, responding characteristic of the expansion valve becomes insensitive. Therefore, if the evaporator has a rapid change of thermal load, the refrigeration cycle can be restricted from having a hunting phenomenon, because the responding characteristic of the expansion valve is insensitive.

Further, JP-A-2001-33123 discloses an adsorbent-charged expansion valve. An upper pressure-responding chamber of a power element and a hollow part of a temperature sensing bar communicate with each other so as to define a space filled with operating fluid. Adsorbent such as activated carbon is arranged in the hollow part, and pores of the adsorbent have diameters corresponding to a molecular diameter of the operating fluid. A lower pressure-responding chamber of the power element communicates with a low-pressure refrigerant passage through a clearance defined around the temperature sensing bar. A temperature of vapor refrigerant flowing through the low-pressure refrigerant passage out of the evaporator is transmitted to the operating fluid of the hollow part. Thus, a pressure corresponding to the transmitted temperature is transmitted to the operating fluid of the upper chamber.

Therefore, a diaphragm of the power element drives the bar based on a pressure difference defined between a gas pressure of the operating fluid in the upper chamber and a vapor pressure of refrigerant at an outlet of the evaporator. Thus, an opening degree of an orifice is controlled by a valve portion, such that a flowing amount of liquid refrigerant into an inlet of the evaporator is controlled.

Due to the activated carbon arranged in the hollow part of the bar, it takes a time to hold a balance of temperature and pressure between the activated carbon and the operating fluid. Therefore, controlling characteristic of the refrigeration cycle becomes stable, and a hunting phenomenon can be restricted from being generated.

JP-A-H09-159324 discloses an expansion valve, in which a resin layer is arranged around an outer circumference of a temperature sensing bar. Heat is transmitted from gas phase low-pressure refrigerant flowing through a low-pressure refrigerant passage, and the heat transmission is delayed by the resin layer. Thus, a time constant can be increased. However, influence of heat transmission from outside air or the expansion valve becomes relatively large relative to sealed refrigerant, because the heat transmission from the low-pressure refrigerant is made low. In this case, a temperature of the bar becomes higher than a temperature of the low-pressure refrigerant. Therefore, temperature detected by the bar may have errors in a steady time when refrigerant has a stable temperature and a constant pressure.

The hunting phenomenon is generated by an interaction between a responding delay of the expansion valve and a responding delay of the cycle. The responding delay of the expansion valve is generated, because a controlling of an opening degree of an orifice corresponding to a decompressing portion is delayed from a detecting of a temperature of refrigerant flowing through an outlet of an evaporator. Therefore, when the responding delay (time constant) of the expansion valve is made sufficiently larger than the responding delay of the cycle, the hunting phenomenon can be reduced. However, the responding delay of the cycle is changed by a variation of a flowing amount (flowing speed) of refrigerant, when an air-conditioning load is changed. In a case that the expansion valve is designed to have a sufficiently large time constant in a condition that the flowing speed of refrigerant is low, the responding delay becomes too large in a condition that the flowing speed of refrigerant is high. Thus, the cycle cannot have a proper operation.

Further, the temperature of the sensing bar is affected by heat transmitted from the diaphragm, because the diaphragm is affected by atmospheric temperature of the expansion valve. Furthermore, because refrigerant is sealed above the diaphragm, temperature distribution may be generated in the longitudinal direction of the sensing bar. Due to the temperature distribution, when the atmospheric temperature is high, for example, refrigerant sealed in the upper chamber may have a temperature higher than a temperature of low-pressure refrigerant flowing through the low-pressure refrigerant passage. In this case, a valve-opening operation may be erroneously performed as malfunction.

JP-A-2001-33123 discloses an expansion valve, in which activated carbon is arranged in a hollow part of a temperature sensing bar. Due to the activate carbon, operating fluid has a time constant to perform a direct heat transmission. The operating fluid is adsorbed on the activated carbon, and is introduced toward the low-pressure refrigerant passage. Thus, an error of the detected refrigerant temperature becomes small. However, cost and man-hour are increased for filling the activated carbon in the hollow part, such that productivity may become worse.

Further, because the operating fluid is adsorbed on the activated carbon, the pressure of the upper chamber is increased in accordance with a temperature increase. In this case, the expansion valve cannot have a MOP (maximum operating pressure) characteristic. When the operating fluid in the seal space is heated to have gas phase, the pressure increasing of the upper chamber becomes slow, in a case that the expansion valve has the MOP characteristic. Thus, power needed for driving a compressor can be reduced at a high load time.

Further, a liquid-charged expansion valve is known as a decompressing device, in which gas-liquid mixture state temperature sensing fluid is filled in a temperature sensing portion. Similarly to JP-A-2001-33123, the liquid-charged expansion valve cannot have the MOP characteristic, because the temperature sensing fluid has a gas-liquid mixture state at a using time. Further, the producing cost is high, because a diaphragm of a power element is required to withstand a high pressure applied at a high pressure time. Further, the productivity of the liquid-charged expansion valve is low due to high cost and large man-hour, compared with the gas-charged expansion valve.

SUMMARY OF THE INVENTION

In view of the foregoing and other problems, it is a first object of the present invention to provide an expansion valve having better productivity. Further, the expansion valve has a time constant effective for restricting a hunting, and malfunction generated by an influence of atmospheric temperature can be reduced.

It is a second object of the present invention to provide a method of producing an expansion valve. Malfunction of the expansion valve generated by an influence of outside air temperature can be reduced.

According to an example of the present invention, a thermal expansion valve is used in a vapor compressing refrigeration cycle so as to decompress and expand high-pressure refrigerant and to send the expanded low-pressure refrigerant toward an inlet of an evaporator. The thermal expansion valve includes a body portion, an element portion, and a valve portion. The body portion has a first refrigerant passage through which the high-pressure refrigerant passes, a throttle passage located in the first refrigerant passage so as to decompress and expand refrigerant, and a second refrigerant passage through which refrigerant flowing out of the evaporator passes. The element portion is arranged outside of the body portion, and has a pressure responding member to be displaced in accordance with a pressure difference between an inner pressure of a seal space and a pressure of refrigerant flowing through the second refrigerant passage. Temperature sensing media is filled in the seal space, and a pressure of the media is changed by a temperature variation. The valve portion is displaced in accordance with a displacement of the pressure responding member so as to control an opening degree of the throttle passage. Additive is filled in the seal space together with the temperature sensing media so as to lower a condensing temperature of the media.

Accordingly, not only the media but also the additive is filled in the seal space of the element portion, such that a condensing temperature of mixture constructed by the media and the additive can be made lower, compared with that of the media. Therefore, compared with a case in which the additive is not added, the mixture in the seal space can be restricted from condensing, even when an outside air temperature becomes low. Further, the pressure of the seal space can be made to correspond to the temperature of refrigerant flowing out of the evaporator. As a result, the valve portion can properly control the opening degree of the throttle passage, even when an outside air temperature becomes low, and malfunction of the thermal expansion valve generated by the influence of the outside air temperature can be reduced.

Further, the element portion is produced by filling a predetermined amount of liquid-phase additive into the seal space, and by filling a predetermined amount of media into the seal space. Before the predetermined amount of liquid phase additive is filled in the seal space, the seal space is filled with gas phase media having temperature and pressure to make the additive to have the liquid phase. Therefore, a proper amount of additive can be filled in the seal space, even when volatile additive is used, although the volatile additive easily evaporates at a pressure equal to or lower than atmospheric pressure. Thus, the condensing temperature of the mixture constructed by the media and the additive can be lowered, compared with the condensing temperature of the media.

According to an example of the present invention, a thermal expansion valve is used in a vapor compressing refrigeration cycle so as to decompress and expand high-pressure refrigerant and to send the expanded low-pressure refrigerant toward an inlet of an evaporator. The thermal expansion valve includes a body portion, an element portion, and a valve portion. The body portion has a first refrigerant passage through which the high-pressure refrigerant passes, a throttle passage located in the first refrigerant passage so as to decompress and expand refrigerant, and a second refrigerant passage through which refrigerant flowing out of the evaporator passes. The element portion is arranged outside of the body portion, and has a pressure responding member to be displaced in accordance with a pressure difference between an inner pressure of a seal space and a pressure of refrigerant flowing through the second refrigerant passage. Temperature sensing media is filled in the seal space, and a pressure of the media is changed by a temperature variation. The valve portion is displaced in accordance with a displacement of the pressure responding member so as to control an opening degree of the throttle passage. Additive is filled in the seal space together with the temperature sensing media so as to lower a condensing temperature of the media. The element portion is produced by filling a predetermined amount of liquid-phase additive into the seal space filled with gas having a temperature and a pressure to make the additive to have the liquid phase. After the filling of the additive, the gas is vacuumed from the seal space, and a predetermined amount of media is filled in the seal space.

Accordingly, not only the media but also the additive is filled in the seal space of the element portion, such that malfunction of the expansion valve generated by influence of outside air temperature can be reduced.

Further, the element portion is formed by filling a predetermined amount of additive having liquid phase into the seal space, by vacuuming gas from the seal space, and by filling a predetermined amount of media into the seal space. Therefore, a proper amount of additive can be filled in the seal space by using non-volatile additive, because the non-volatile additive is difficult to evaporate in a negative pressure. Thus, the condensing temperature of the mixture constructed by the media and the additive can be lowered, compared with the condensing temperature of the media.

According to an example of the present invention, a thermal expansion valve is used in a vapor compressing refrigeration cycle so as to decompress and expand high-pressure refrigerant and to send the expanded low-pressure refrigerant toward an inlet of an evaporator. The thermal expansion valve includes a body portion, an element portion, and a valve portion. The body portion has a first refrigerant passage through which the high-pressure refrigerant passes, a throttle passage located in the first refrigerant passage so as to decompress and expand refrigerant, and a second refrigerant passage through which refrigerant flowing out of the evaporator passes. The element portion is arranged outside of the body portion, and has a pressure responding member to be displaced in accordance with a pressure difference between an inner pressure of a seal space and a pressure of refrigerant flowing through the second refrigerant passage. Temperature sensing media is filled in the seal space, and a pressure of the media is changed by a temperature variation. The valve portion is displaced in accordance with a displacement of the pressure responding member so as to control an opening degree of the throttle passage. Additive is filled in the seal space together with the temperature sensing media so as to lower a condensing temperature of the media. The element portion is produced by vacuuming gas from the seal space, by filling a predetermined amount of gas phase media into the vacuumed seal space, and by filling a predetermined amount of liquid phase additive into the vacuumed seal space.

Accordingly, not only the media but also the additive is filled in the seal space of the element portion, such that malfunction of the expansion valve generated by influence of outside air temperature can be reduced.

Further, the element portion is formed by vacuuming gas from the seal space, by filling the predetermined amount of the gas phase media into the vacuumed seal space, and by filling the predetermined amount of the liquid phase additive into the vacuumed seal space. Therefore, a proper amount of additive can be filled in the seal space by using volatile additive, although the volatile additive easily evaporates in a negative pressure. Thus, the condensing temperature of the mixture constructed by the media and the additive can be lowered, compared with the condensing temperature of the media.

According to an example of the present invention, a thermal expansion valve is used in a vapor compressing refrigeration cycle so as to decompress and expand high-pressure refrigerant and to send the expanded low-pressure refrigerant toward an inlet of an evaporator. The thermal expansion valve includes a body portion, an element portion, and a valve portion. The body portion has a first refrigerant passage through which the high-pressure refrigerant passes, a throttle passage located in the first refrigerant passage so as to decompress and expand refrigerant, and a second refrigerant passage through which refrigerant flowing out of the evaporator passes. The element portion is arranged outside of the body portion, and has a pressure responding member to be displaced in accordance with a pressure difference between an inner pressure of a seal space and a pressure of refrigerant flowing through the second refrigerant passage. Temperature sensing media is filled in the seal space, and a pressure of the media is changed by a temperature variation. The valve portion is displaced in accordance with a displacement of the pressure responding member so as to control an opening degree of the throttle passage. Additive is filled in the seal space together with the temperature sensing media so as to lower a condensing temperature of the media.

Accordingly, not only the media but also the additive is filled in the seal space of the element portion, such that malfunction of the expansion valve generated by influence of outside air temperature can be reduced.

According to an example of the present invention, the media and the additive have a relationship of $$0.80 \geq Ma/(Ma+Mr)$$

when the media is set to have a predetermined amount Mr (unit: mole), and when the additive is set to have a predetermined amount of Ma (unit: mole).

Accordingly, the condensing temperature of the mixture constructed by the media and the additive is properly lowered in a practical range of environment temperature (outside temperature) of the refrigeration cycle having the thermal expansion valve.

According to an example of the present invention, the expansion valve includes an additive retainer to retain the additive.

Accordingly, the additive can be temporally retained due to the additive retainer. Further, the retainer is located in the seal space of the element portion or a space communicating with the seal space. Therefore, the additive can be restricted from leaking from the seal space, even when vibration is generated in a producing process of the expansion valve.

According to an example of the present invention, the thermal expansion valve includes a temperature sensing bar to transmit the displacement of the pressure responding member to the valve portion, and to transmit a temperature of refrigerant passing through the second refrigerant passage to the media. The temperature sensing bar has a column space extending in an axis direction of the temperature sensing bar and communicating with the seal space. The column space accommodates a thermal ballast member made of a material having a heat capacity higher than that of the temperature sensing bar.

Accordingly, because the expansion valve includes the thermal ballast member made of the material having the higher heat capacity, a speed of transmitting heat from the sensing bar to the mixture of the media and the additive can be changed. Therefore, rapid displacement of the valve portion can be restricted, such that unstable operation (hunting phenomenon) of the refrigeration cycle can be reduced.

According to an example of the present invention, the thermal expansion valve includes a temperature sensing bar to transmit the displacement of the pressure responding member to the valve portion, and to transmit a temperature of refrigerant passing through the second refrigerant passage to the media. The temperature sensing bar has a column space extending in an axis direction of the temperature sensing bar and communicating with the seal space. The column space accommodates a heat conductivity low member made of a material having heat conductivity lower than that of the temperature sensing bar.

Accordingly, because the expansion valve includes the heat conductivity low member made of the material having the lower heat conductivity, a speed of transmitting heat from the sensing bar to the mixture of the media and the additive can be changed. Therefore, rapid displacement of the valve portion can be restricted, such that unstable operation (hunting phenomenon) of the refrigeration cycle can be reduced.

According to an example of the present invention, a thermal expansion valve includes a temperature sensing bar to transmit the displacement of the pressure reacting member to the valve portion, and to transmit a temperature of refrigerant passing through the second refrigerant passage to the media. The temperature sensing bar has a column space extending in an axis direction of the temperature sensing bar and communicating with the seal space. The column space is defined to have an upper part located adjacent to the pressure responding member and a lower part located adjacent to the valve portion. The lower part has an inner diameter smaller than that of the upper part, in a cross-section of the column space in the axis direction.

Accordingly, a speed of transmitting heat from the sensing bar to the mixture of the media and the additive can be changed based on positions of the sensing bar. Therefore, rapid displacement of the valve portion can be restricted, such that unstable operation (hunting phenomenon) of the refrigeration cycle can be reduced, which is one of malfunctions of the expansion valve.

According to an example of the present invention, an expansion valve includes a body portion, an orifice, a valve portion, a power element, a first pressure responding chamber, a second pressure responding chamber, a temperature sensing bar, a heat conductivity low layer, and a piston. The body portion has a first passage through which liquid refrigerant flows from a compressor, and a second passage through which gas refrigerant flows from an evaporator to the compressor. The orifice is defined in the first passage, and the valve portion controls an amount of refrigerant passing through the orifice. The power element has a diaphragm arranged in the body portion, and the diaphragm is driven by a pressure difference. The upper pressure responding chamber is defined above the diaphragm in the power element, and the lower pressure responding chamber is defined under the diaphragm so as to communicate with the second passage. The temperature sensing bar has a tube space extending in an axis direction of the bar. At least a part of the bar is located in the second passage. An upper end of the bar contacts with the diaphragm, and a lower end of the bar drives the valve portion. The bar is displaced in accordance with a displacement of the diaphragm. The layer has a heat conductivity lower than that of a material defining the temperature sensing bar, and is arranged on an inner wall of the temperature sensing bar. The piston separates the tube space of the temperature sensing bar into a first space and a second space, and is slidably moved in an axis direction of the tube, space.

Further, the tube space of the sensing bar communicates with the first chamber through an opening defined in the diaphragm. The two spaces separated by the piston are constructed by a first space and a second space. The first space located adjacent to the first chamber is filled with incompressible fluid, and a volume change of the fluid generated by a pressure change is small. The second space is located in the second passage opposite from the first chamber, and is filled with gas phase refrigerant.

Accordingly, the following advantages can be obtained. Because the gas phase refrigerant is filled in the second space located in the second passage through which the low-pressure refrigerant flows, gas-charged expansion valve can be provided. Cost and man-hour for producing the gas-charged expansion valve are lower than those for producing a liquid-charged or adsorbent-charged expansion valve. Thus, the productivity can be improved. Because the volume variation of the incompressible fluid is small, the volume variation generated by atmospheric temperature variation is small. Therefore, the displacement amount of the piston generated by the volume change of the incompressible fluid is sufficiently smaller than that generated by a displacement of the diaphragm. Therefore, when the incompressible fluid is filled in the first space, the volume change of the first space is small. Thus, the expansion valve can be operated without being affected by atmospheric temperature variation. Further, due to the heat conductivity low layer, time constant of heat transmission can be made larger, and a hunting phenomenon can be easily restricted.

Thus, the productivity of the expansion valve can be increased. Further, time constant can be set effective for preventing the hunting phenomenon, and malfunction generated by influence of the atmospheric temperature can be reduced.

According to an example of the present invention, the expansion valve includes a shape-changeable member in place of the piston. The shape-changeable member is fixed to an inner wall of the tube space so as to separate the tube space into two spaces. The shape-changeable member is deformed by a pressure difference.

Accordingly, the shape-changeable member can be flexibly deformed by a pressure difference between the refrigerant and the fluid. Therefore, the shape-changeable member can achieve the same function as the piston. Further, a structure of the shape-changeable member is simple compared with that of the piston sliding in the tube space, because the shape-changeable member can be made of a membrane shaped soft material such as rubber.

According to an example of the present invention, the first space filled with the incompressible fluid is located lower than the second space filled with the gas phase refrigerant.

Accordingly, the gas phase refrigerant can be filled in the first space after the fluid is filled in the second space. Further, the power element including the fluid and the refrigerant can be mounted to a predetermined position of the body portion. Thus, a sealing member needed for filling the fluid is not needed, such that a construction of the expansion valve can be simplified.

According to an example of the present invention, an expansion valve includes a body portion, an orifice, a valve portion, a power element, a first pressure responding chamber, a second pressure responding chamber, a temperature sensing bar, and a heat conductivity low layer. The body portion has a first passage through which liquid refrigerant flows from a compressor, and a second passage through which gas refrigerant flows from an evaporator to the compressor. The orifice is defined in the first passage, and the valve portion controls an amount of refrigerant passing through the orifice. The power element has a diaphragm arranged in the body portion, and the diaphragm is driven by a pressure difference. The upper pressure responding chamber is defined above the diaphragm in the power element, and the lower pressure responding chamber is defined under the diaphragm so as to communicate with the second passage. The temperature sensing bar has a tube space extending in an axis direction of the bar. At least a part of the bar is located in the second passage. An upper end of the bar contacts with the diaphragm, and a lower end of the bar drives the valve portion. The bar is displaced in accordance with a displacement of the diaphragm. The layer has a heat conductivity lower than that of a material defining the temperature sensing bar, and is arranged on an inner wall of the temperature sensing bar.

Further, the tube space of the sensing bar communicates with the upper chamber through an opening defined in the diaphragm. A space is defined from the upper chamber to the tube space of the sensing bar, and the space has an upper part and a lower part. Incompressible fluid is filled and sealed in the upper part including at least the upper chamber. A volume variation of fluid generated by a pressure variation is small. Gas phase refrigerant is filled and sealed in the lower part. The fluid and the refrigerant have a relationship resolving with each other at a predetermined ratio. The fluid has a drag force generated by a surface tension to restrict from falling in a lower part of the tube space of the sensing bar. The drag force is larger than a gravity force of fluid applied to an interface between the fluid and the refrigerant.

Accordingly, the drag force can be made larger than the gravity force in consideration of a level of the resolving characteristic. Therefore, the fluid and the refrigerant form two layers in which a predetermined amount of the fluid and a predetermined amount of the refrigerant resolve with each other, and a balance of the two layers is maintained at the interface. Further, a volume variation generated by a pressure variation is small in the incompressible fluid filled in the upper space. Therefore, a volume variation generated by atmospheric temperature variation is small. The displacement amount generated by the volume change is sufficiently smaller than that generated by a displacement of the diaphragm. The volume change of the incompressible fluid filled in the upper chamber is small, such that influence of the atmospheric temperature variation can be reduced relative to an operation of the expansion valve.

Further, because the gas phase refrigerant is filled in the lower space, gas-charged expansion valve can be provided. Cost and man-hour for producing the gas-charged expansion valve are lower than those for producing a liquid-charged or adsorbent-charged expansion valve. Thus, the productivity can be improved. Further, due to the heat conductivity low layer, time constant of heat transmission can be made larger, and a hunting phenomenon can be easily restricted.

Thus, the productivity of the expansion valve can be increased. Further, time constant can be set effective for preventing the hunting phenomenon, and malfunction generated by influence of the atmospheric temperature can be reduced.

According to an example of the present invention, the incompressible fluid and the gas phase refrigerant disable to resolve with each other. Accordingly, the fluid and the refrigerant are completely separated into two layers, and a balance is maintained at an interface of the two layers. Thus, the expansion valve can be easily designed without considering compatibility of the fluid and the refrigerant, so as to make the drag force larger than the gravity force.

According to an example of the present invention, the expansion valve includes a surface tension raising portion arranged on the interface between the incompressible fluid and the gas phase refrigerant. The surface tension raising portion is located to cross the tube space of the temperature sensing bar. Accordingly, the surface tension can be increased, and the balance between the fluid and the refrigerant can be more stably maintained.

According to an example of the present invention, the heat conductivity low layer is made of resin. Accordingly, the heat conductivity low layer can be formed by a method having a high productivity. For example, insert molding may be performed.

According to an example of the present invention, the incompressible fluid is one of PGA oil, silicon oil, and fluorinated oil.

DETAILED DESCRIPTION OF PREFERRED EMBODIMENT

First Embodiment

Figure 1:
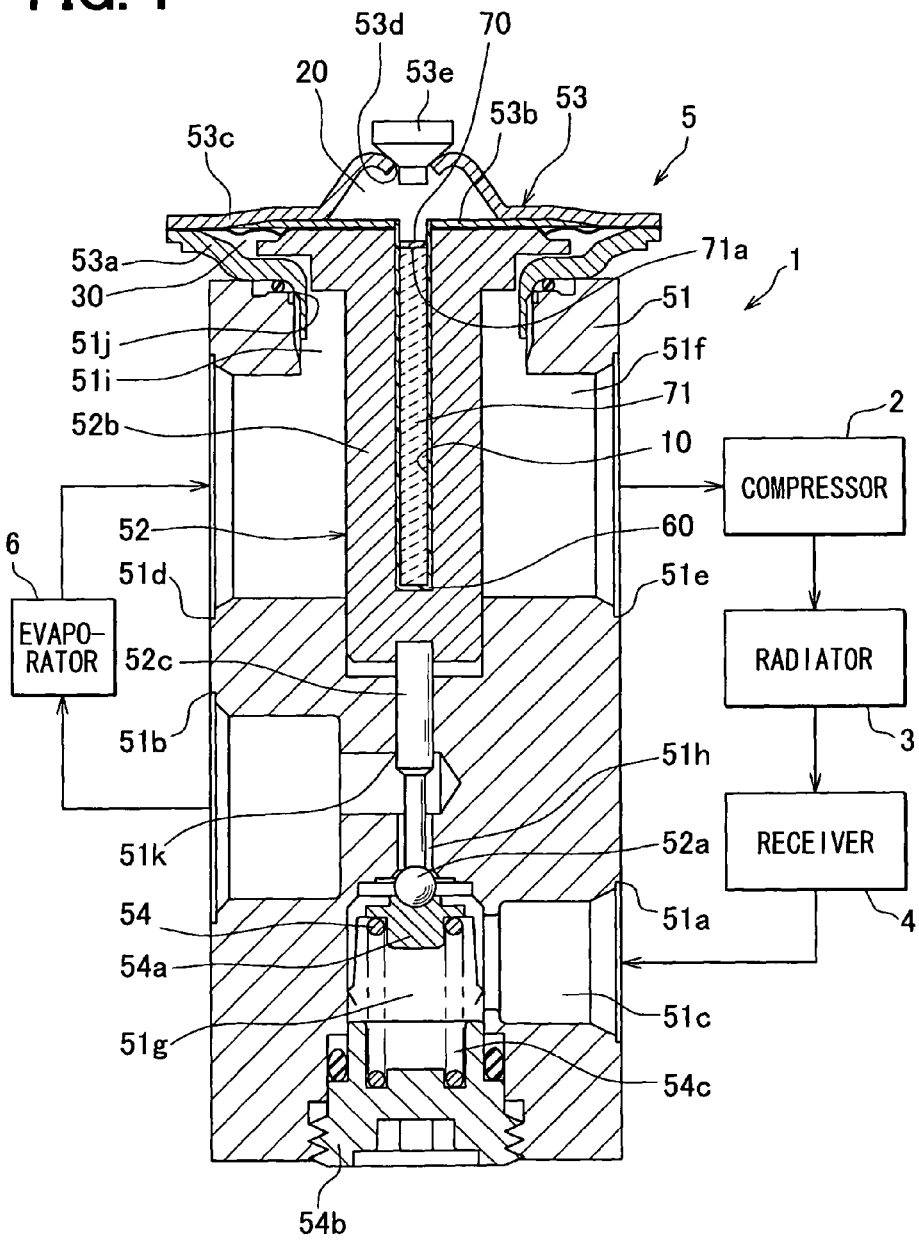
FIG. 1 is a cross-sectional view illustrating a thermal expansion valve according to first, second and third embodiments of the present invention.

A first embodiment will be described with reference to FIGS. 1 and 2, in which the present invention is applied for a thermal expansion valve used in a vapor-compressing refrigeration cycle. FIG. 1 is a cross-sectional view of a thermal expansion valve 5 of the present embodiment.

In the present embodiment, a vapor-compressing refrigeration cycle 1 having the thermal expansion valve 5 is used in an air-conditioning apparatus for a vehicle. FIG. 1 shows schematic connection relationship between devices of the refrigeration cycle 1.

Fluorocarbon refrigerant R134a is used in the refrigeration cycle 1, and a sub-critical cycle is constructed in which a pressure of high-pressure side refrigerant does not exceed the critical pressure. In the refrigeration cycle 1 of FIG. 1, a compressor 2 is driven by a non-illustrated vehicle engine through an electromagnetic clutch, for example, so as to draw and compress refrigerant.

A radiator 3 makes heat exchanged between high-pressure refrigerant discharged from the compressor 2 and outside air sent by a non-illustrated cooling fan, thereby the high-pressure refrigerant emits heat so as to be condensed. The radiator 3 corresponds to a heat-emitting heat exchanger. A receiver 4 is connected to an outlet side of the radiator 3. The receiver 4 separates refrigerant flowing out of the radiator 3 into gas and liquid, and stores extra liquid refrigerant of the cycle. Further, the thermal expansion valve 5 is connected to a liquid refrigerant outlet of the receiver 4.

The thermal expansion valve 5 depressurizes and expands high-pressure refrigerant flowing out of the receiver 4. Further, a valve opening of the expansion valve 5 is changed based on a temperature and a pressure of refrigerant flowing out of an evaporator 6, in a manner that a superheat degree of refrigerant flowing out of the evaporator 6 becomes closer to a predetermined value. The valve opening corresponds to a throttle passage area. Thus, the expansion valve 5 controls an amount of refrigerant flowing toward an inlet of the evaporator 6. A specific construction of the expansion valve 5 will be described below.

The evaporator 6 makes heat exchanged between low-pressure refrigerant depressurized and expanded by the expansion valve 5 and air sent by a non-illustrated air-sending fan. The evaporator 6 corresponds to a heat-absorbing heat exchanger to make the low-pressure refrigerant to evaporate. Further, an outlet side of the evaporator 6 is connected to a drawing side of the compressor 2 through a second refrigerant passage 51*f* of the expansion valve 5.

Next, a specific construction of the thermal expansion valve 5 will be described. An inner pressure of the expansion valve 5 is uniform, and, as shown in FIG. 1, the expansion valve 5 includes a body portion 51, a valve portion 52, and an element portion 53.

The body portion 51 defines a casing of the expansion valve 5 and a refrigerant passage in the expansion valve 5, and is produced by drilling a hole in a cylinder-shaped block or a prism-shaped block, for example. The body portion 51 has first and second refrigerant inlets 51*a*, 51*d*, first and second refrigerant outlets 51*b*, 51*e*, a valve chamber 51*g*, a throttle passage 51*h*, a communication chamber 51*i*, a mount hole 51*j* and so on.

The first inlet 51*a* is connected to the liquid refrigerant outlet of the receiver 4 so as to make high-pressure liquid refrigerant to flow in. The first outlet 51*b* makes refrigerant to flow toward the evaporator 6 from the first inlet 51*a*. Therefore, a first refrigerant passage 51*c* is defined from the first inlet 51*a* to the first outlet 51*b*.

The second inlet 51*d* makes low-pressure refrigerant flowing out of the evaporator 6 to flow into the expansion valve 5. The second outlet 51*e* makes refrigerant to flow toward the compressor 2 from the second inlet 51*d*. Therefore, the second refrigerant passage 51*f* is defined from the second inlet 51*d* to the second outlet 51*e*.

The valve chamber 51*g* is defined in the first refrigerant passage 51*c*, and accommodates a sphere valve 52*a* of the valve portion 52. Specifically, the valve chamber 51*g* directly communicates with the first inlet 51*a*, and communicates with the first outlet 51*b* through the throttle passage 51*h*. The throttle passage 51*h* is located in the first refrigerant passage 51*c*, and introduces refrigerant flowing into the valve chamber 51*g* toward the first outlet 51*b*. At this time, refrigerant is depressurized and expanded.

The mount hole 51*j* is defined in the second refrigerant passage 51*f*, and is located on a top face of the body portion 51. The communication chamber 51*i* is defined to communicate with the mount hole 51*j*. The element portion 53 to be described below is mounted to the mount hole 51*j* from an outside of the body portion 51.

The valve portion 52 includes the sphere valve 52*a*, a temperature sensing bar 52*b*, and an operation bar 52*c*. The sphere valve 52*a* is arranged on an end of the valve portion 52. The temperature sensing bar 52*b* has an approximately cylinder shape, and is connected to a diaphragm 53*b* of the element portion 53 by a connecting portion such as welding or adhesive. The operation bar 52*c* has an approximately cylinder shape, and is fitted into the temperature sensing bar 52*b* with the same axis so as to contact with the sphere valve 52*a*.

The sphere valve 52*a* controls a refrigerant passage area of the throttle passage 51*h* by displacing the bars 52*b*, 52*c* in the axis direction. The valve chamber 51*g* accommodates a coil spring 54, which biases the sphere valve 52*a* in a direction closing the throttle passage 51*h* through a support member 54*a*. A load of the biasing force of the coil spring 54 is changeable by controlling a screw 54*b*.

The temperature sensing bar 52*b* extends to pass through the communication chamber 51*i* and the mount hole 51*j*. An outer circumference face of the bar 52*b* is exposed to refrigerant passing through the second refrigerant passage 51*f* and the communication chamber 51*i*. Therefore, the bar 52*b* transmits the temperature of refrigerant passing through the second refrigerant passage 51*f* toward the element portion 53.

Further, an approximately column-shaped space 10 is defined in the temperature, sensing bar 52*b* so as to extend in the axis direction of the bar 52*b*. A heat insulation member 60 is arranged on an inner wall face of the column space 10. The heat insulation member 60 is made of a material having a heat conductivity lower than that of the temperature sensing bar 52*b*. Specifically, heat insulation member 60 is formed by molding resin such as polyoxymethylene (POM) into a based cylinder, and is fitted into the column space 10 so as to tightly contact with the inner wall face of the column space 10.

A granular thermal ballast member 71 is filled in the column space 10 through the heat insulation member 60, and has a heat capacity higher than that of the temperature sensing bar 52*b*. Specifically, the ballast member 71 is made of granular ceramics such as alumina-silica.

Further, an additive retainer 70 is arranged on a filling face 71*a* of the ballast member 71 opposing to a seal space 20. The additive retainer 70 is located on the most top face of the ballast member 71. The retainer 70 temporally adsorbs and retains additive to be described below, and corresponds to a sponge member made of porous resin such as polyurethane.

The operation bar 52*c* is arranged to pass through a valve location hole 51*k* and the throttle passage 51*h*. The valve location hole 51*k* is defined in the body portion 51 so as to connect the communication chamber 51*i* and the valve chamber 51*g*. A clearance defined between the hole 51*k* and the operation bar 52*c* is sealed by a non-illustrated sealing member such as an O-ring. Therefore, refrigerant is restricted from leaking from the clearance, even when the valve portion 52 is displaced.

The element portion 53 includes an element housing 53*a*, the diaphragm 53*b*, and an element cover 53*c*. The housing 53*a* is mounted to the mount hole 51*j* by a fixing portion such as a screw. The diaphragm 53*b* corresponds to a reaction member to respond to a pressure variation. An outer periphery of the diaphragm 53*b* is supported between the element housing 53*a* and the element cover 53*c*. The element cover 53*c* forms an outer frame of the element portion 53.

The element housing 53*a* and the element cover 53*c* have cup shapes made of metal such as stainless steel (SUS304). Circumference ends of the housing 53*a* and the cover 53*c* are integrally welded by a connecting portion such as brazing, in a state that the outer periphery of the diaphragm 53*b* is supported between the housing 53*a* and the cover 53*c*. Therefore, an inner space of the element portion 53 defined by the housing 53*a* and the cover 53*c* is separated into two spaces by the diaphragm 53*b*.

One of the two spaces is the seal space 20 defined between the cover 53*c* and the diaphragm 53*b*. Temperature sensing media is filled in the seal space 20, and a pressure of the media is changed in accordance with the temperature of refrigerant flowing out of the evaporator 6. Further, additive is filled in the seal space 20, and lowers a condensing temperature of the media. The media and the additive are specifically described below. The seal space 20 communicates with the column space 10 of the temperature sensing bar 52*b* through a through hole defined to pass through at an approximately center position of the diaphragm 53*b*.

The other of the two spaces is an introduction space 30 defined between the housing 53*a* and the diaphragm 53*b*. The introduction space 30 communicates with the communication chamber 51*i*, such that refrigerant flowing out of the evaporator 6 is introduced into the space 30. Therefore, the temperature of refrigerant flowing through the second refrigerant passage 51*f* is transmitted to a mixture of the media and the additive filled in the spaces 10, 20 through the temperature sensing bar 52*b*. Further, the temperature of refrigerant introduced into the introduction space 30 is transmitted to the mixture of the media and the additive filled in the spaces 10, 20 through the diaphragm 53*b*.

Therefore, inner pressures of the spaces 10, 20 correspond to the temperature of refrigerant flowing out of the evaporator 6. The diaphragm 53*b* is displaced based on a pressure difference between the inner pressure of the space 10, 20 and the inner pressure of the space 30 into which refrigerant flows from the evaporator 6. The diaphragm 53*b* is favorably made of a stiff material having large elasticity and large heat conductivity. For example, the diaphragm 53*b* may be a thin board made of stainless steel such as SUS304.

As shown in FIG. 1, the element cover 53*c* has a hole 53*d* used for filling the media and the additive into the seal space 20. The hole 53*d* is closed by a sealing plug 53*e*, in a state that the media and the additive are filled in the seal space 20 and the column space 10 (hereinafter simply described as the seal space 20).

The media and the additive filled in the space 20 will be described. In the present embodiment, refrigerant (R134a) circulating in the refrigeration cycle 1 is used as the temperature sensing media, and a predetermined amount of the media is filled in the seal space 20. The predetermined amount is set in a manner that the inner pressure of the seal space 20 is varied within a predetermined range based on the temperature of refrigerant flowing out of the evaporator 6.

Further, ethanol ($C_2H_6O$) is used as the additive to lower the condensing temperature of the media. A predetermined amount of the additive is filled in the seal space 20. Ethanol easily evaporates under atmospheric pressure. Further, the predetermined amount of the additive is determined by using Raoult's law in the present embodiment. A vapor pressure decreasing of a solution is proportional to a concentration of a dissolved substance of the solution, in Raoult's law represented by following Formulas F1 and F2.

$$\eta m=\beta\times Wr/\{(1-\beta)\times Wa+\beta\times Wr\} \quad \text{(F1)}$$

$$P=Pr(1-\eta m) \quad \text{(F2)}$$

Wr represents a molecular weight of the media filled in the seal space 20. Wa represents a molecular weight of the additive filled in the seal space 20. β is a ratio of the additive to the mixture. Pr represents a saturated vapor pressure of purified media, and P represents a saturated vapor pressure of the mixture.

Therefore, ηm of Formula F1 represents a mole fraction of the additive to the mixture. As clarified in Formula F2, the saturated vapor pressure of the mixture is decreased, as the mole fraction ηm of the additive is increased. That is, the condensing temperature of the media in the mixture can be decreased by increasing the mole fraction of the additive in the mixture.

Therefore, in the present embodiment, when the predetermined amount of the media filled in the seal space 20 is defined to have a value of Mr (unit: mole), and when the predetermined amount of the additive filled in the seal space 20 is defined to have a value of Ma (unit: mole), the following Formula F3 is defined.

$$0.80\geq Ma/(Ma+Mr) \quad \text{(F3)}$$

A right side of Formula F3 is a value corresponding to the mole fraction ηm of the additive to the mixture. A left side value of 0.80 is set so as to prevent an unnecessary lowering of the condensing temperature.

The above feature will be described with reference to FIG. 2. FIG. 2 is a graph illustrating a variation of a vapor pressure decreasing ratio P/Pr in accordance with a variation of the mole fraction ηm. The decreasing ratio P/Pr is a ratio of a saturated vapor pressure P of the mixture to a saturated vapor pressure Pr of purified, temperature sensing media. As clearly shown in FIG. 2, when the mole fraction ηm is increased to be about 0.8, the decreasing ratio P/Pr is decreased to be about 0.2. When the saturated vapor pressure Pr of purified media R134a at 0° C. is multiplied by 0.2, the multiplied value corresponds to the saturated vapor pressure at about −25° C. Therefore, when the mole fraction ηm is increased to be about 0.8, the mixture in the seal space 20 does not condense, even if the temperature of the mixture is decreased to be about −25° C.

In this embodiment, the media R134a is also used as the refrigerant circulating in the refrigeration cycle 1. Therefore, in a case that the outside air temperature is −25° C., when the temperature of the high-pressure refrigerant of the radiator 3 is decreased to be about −25° C., the pressure of the high-pressure refrigerant is decreased to be equal to or lower than the atmospheric pressure. In this case, pressure difference needed for evaporating refrigerant in the evaporator 6 cannot be maintained, such that the refrigeration cycle 1 collapses. Therefore, if the temperature of the mixture filled in the seal space 20 is decreased to be about −25° C. due to the decreasing of the outside air temperature, it is unnecessary to restrict the mixture from condensing.

In the present embodiment, the mole fraction ηm is set so as to satisfy Formula F3, and the predetermined amount Ma of the additive is set based on the set mole fraction ηm and a value of the predetermined amount Mr of the media. Specifically, in this embodiment, when a volume of the seal space 20 is defined to be 1 cc, ethanol of 0.1 g is filled in the seal space 20 as the additive.

The predetermined amount Ma of the additive may be set to satisfy Formula of 0.90≥Ma/(Ma+Mr) in consideration of an error generated when the additive is filled. Further, a lower limit value of Ma/(Ma+Mr) may be set based on the lowest outside air temperature of environment in which the refrigeration cycle 1 is used. For example, when the lowest outside air temperature is defined to be −1° C., the predetermined amount Ma of the additive may be set to satisfy Formula of Ma/(Ma+Mr)≥0.1. That is, in consideration of practical temperature range of the refrigeration cycle 1, the predetermined amount Ma of the additive can be set in a range of 0.90≥Ma/(Ma+Mr)≥0.1.

Figure 2:
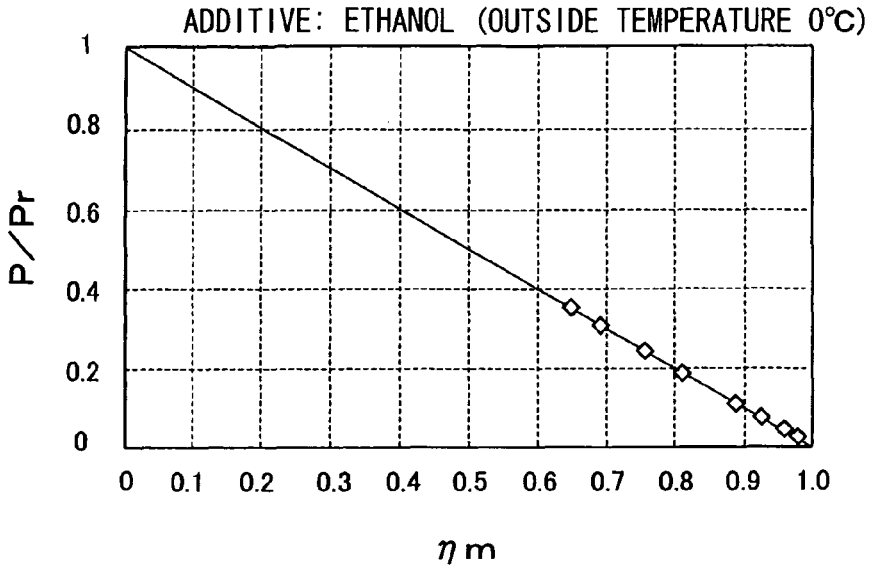
FIG. 2 is a graph illustrating a relationship between a mole fraction nm and a vapor pressure decreasing ratio P/Pr.

Further, the vapor pressure decreasing ratio P/Pr of FIG. 2 depends on the mole fraction ηm, in spite of kinds of the additive. Therefore, an allowable range for the predetermined amount Ma of the additive may be set for additive other than ethanol.

A method of producing the thermal expansion valve 5 of the present embodiment will be described.

A thermal expansion valve, in which the hole 53*d* of the element cover 53*c* of FIG. 1 is not closed by the plug 53*e*, is prepared. At this time, the media nor the additive are not filled in the seal space 20. In contrast, the heat insulation member 60, the ballast member 71 and the retainer 70 are mounted in the column space 10.

Specifically, the based-cylinder shape heat insulation member 60 is fitted to the inner wall face of the column space 10. The granular ballast member 71 is filled in the heat insulation member 60, and the retainer 70 is fitted so as to contact with the filling face 71*a* of the ballast member 71. The heat insulation member 60, the ballast member 71 and the retainer 70 may be mounted through the through hole of the diaphragm 53*b*, after the diaphragm 53*b* and an upper face of the temperature sensing bar 52*b* are welded by laser welding, for example. Thus, the heat insulation member 60, the ballast member 71 and the retainer 70 can be restricted from being deteriorated by heat generated by the welding.

Figure 3:
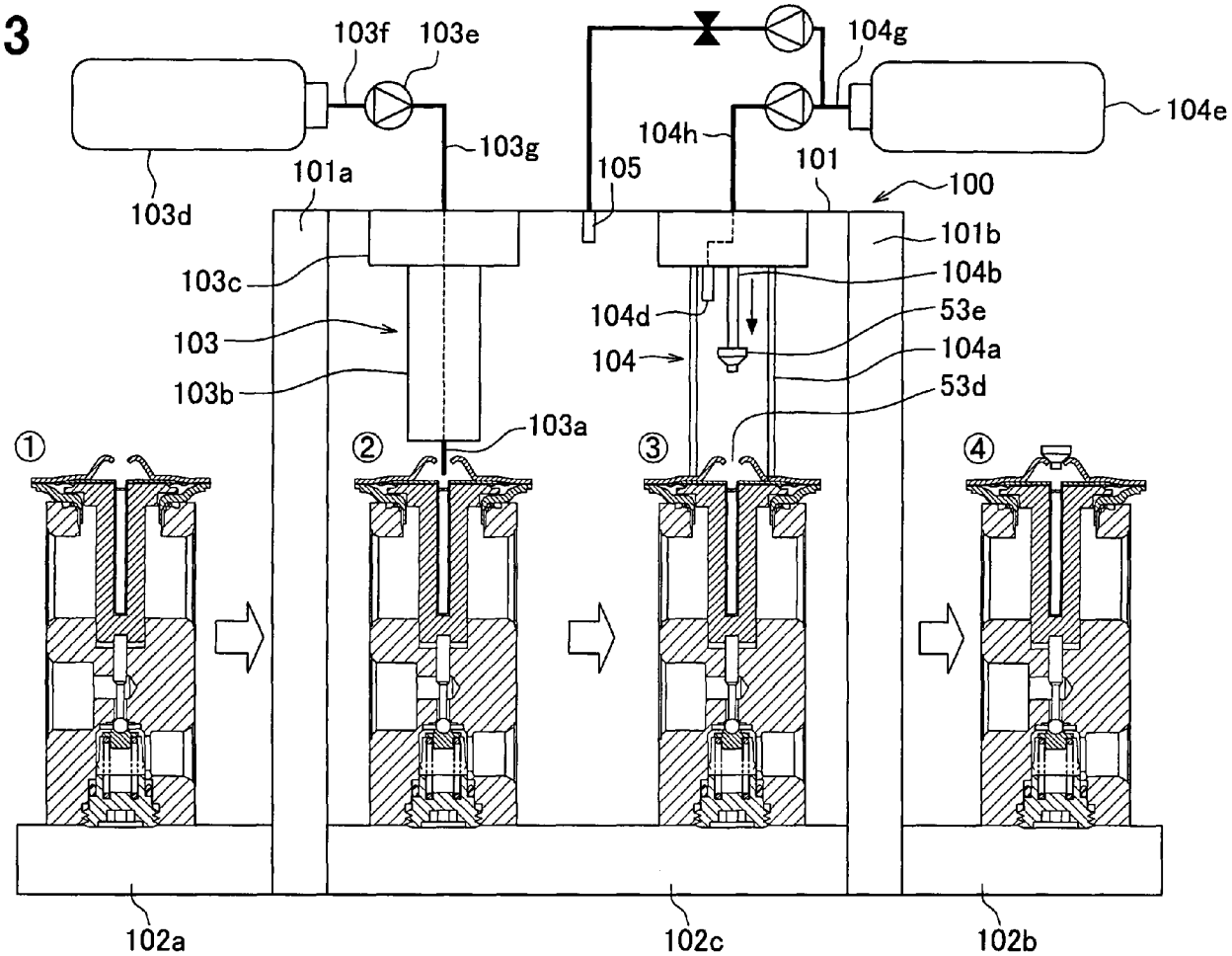
FIG. 3 is a diagram illustrating a producing process of the thermal expansion valve of the first embodiment.

A process for filling the media and the additive into the seal space 20 of the element portion 53 will be described with reference to FIG. 3. FIG. 3 is a diagram illustrating a filling and sealing process of the present embodiment.

Equipment 100 used for the filling and sealing process will be described. The equipment 100 includes an airtight case 101 maintaining air-tightness. Filling and sealing operations are performed inside of the case 101. The case 101 has an inlet air shutter 101*a* and an outlet air shutter 101*b*. An expansion valve to have the filling and sealing process is introduced into the case 101 through the inlet air shutter 101*a*. The expansion valve 5 after having the process is taken out of the case 101 through the outlet air shutter 101*b*. The shutter 101*a*, 101*b* is able to maintain the air-tightness of the case 101. An inlet side carrier 102*a* is connected to the inlet air shutter 101*a* so as to send the expansion valve to have the process. An outlet side carrier 102*b* is connected to the outlet air shutter 101*b* so as to send the expansion valve 5 after having the process. An inside carrier 102*c* is arranged in the case 101 so as to connect the shutters 101*a*, 101*b*. The carrier 102*a*, 102*b*, 102*c* may be a belt conveyor, for example.

An additive filling equipment 103 and a temperature sensing media filing equipment 104 are arranged in the case 101.

The additive filling equipment 103 includes an additive filling nozzle 103*a*, an additive filling arm 103*b*, and an additive controller 103*c*: The nozzle 103*a* is inserted into the hole 53*d*. The arm 103*b* makes the nozzle 103*a* to move upward or downward. The controller 103*c* controls a pressure and an amount of additive injected from the nozzle 103*a*. An additive tank 103*d* is connected to the controller 103*c*. The tank 103*d* is arranged outside, and is made of a tightly-closed container in which ethanol ($C_2H_6O$) is filled as the additive. An additive pump 103*e* is arranged between the tank 103*d* and the controller 103*c*. The pump 103*e* sucks additive filled in the tank 103*d*, and pressurizes the additive for the controller 103*c*. The tank 103*d* and the pump 103*e* are connected by an additive hose 103*f*. The hose 103*f* is made of a material, which is not deteriorated by ethanol ($C_2H_6O$) corresponding to the additive. The pump 103*e* and the controller 103*c* are connected by an additive hose 103*g*. The hose 103*g* is made of a material, which is not deteriorated by ethanol ($C_2H_6O$) corresponding to the additive.

The media filling equipment 104 includes a cylinder-shaped shield 104*a*, which tightly contacts with the element cover 53*c*. Non-illustrated gasket is mounted between the shield 104*a* and the element cover 53*c* contacting with each other. A media controller 104*c* is arranged on a top face of the shield 104*a* so as to control a flowing amount and a pressure of the media. The shield 104*a* maintains air-tightness between the element cover 53*c* and the controller 104*c*. The shield 104*a* is able to extend or shrink in the up-and-down direction due to the controller 104*c*. The shield 104*a* tightly contacts with the element cover 53*c*, and can be separated from the element cover 53*c* after the process is finished, because the shield 104*a* can extend or shrink in the up-and-down direction.

A sealing plug arm 104*b* is arranged in the shield 104*a*. The arm 104*b* moves downward from the controller 104*c*. The arm 104*b* presses the sealing plug 53*e* into the hole 53*d*, and fixes the plug 53*e* by spot welding so as to tightly seal the hole 53*d*. Further, a media injection nozzle 104*d* is arranged in the shield 104*a*, and injects the media inside of the shield 104*a*. The nozzle 104*d* is connected to the controller 104*c*, and a flowing amount and a pressure of the media is controlled by the controller 104*c*.

A media tank 104*e* is connected to the controller 104*c*. The tank 104*e* is arranged outside, and is made of a tightly-closed container in which the media R134a is filled. A media pump 104*f* is arranged between the tank 104*e* and the controller 104*c*. The pump 104*f* sucks the media filled in the tank 104*e*, and pressurizes the media for the controller 104*c*. The tank 104*e* and the pump 104*f* are connected by a media hose 104*g*. The hose 104*g* is made of a material, which is not deteriorated by the media R134a. The pump 104*f* and the controller 104*c* are connected by a media hose 104*h*. The hose 104*h* is made of a material, which is not deteriorated by the media R134a.

A media injection nozzle 105 is arranged in the case 101, and injects the media so as to fill the case 101 with the media. The tank 104*e* is connected to the nozzle 105. A media pump 105*a* is arranged between the tank 104*e* and the nozzle 105. The pump 105*a* sucks the media filled in the tank 104*e*, and pressurizes the media for the nozzle 105. Further, a media pressure controlling valve 105*b* is arranged between the nozzle 105 and the pump 105*a*, and controls a pressure of media in the case 101.

The filling and sealing process performed by the equipment 100 will be described. Gas (air) is released from the case 101 through a non-illustrated air vent hole. At this time, gas-phase media is injected from the nozzle 105, thereby inside of the case 101 is purged by the media. Thus, the media is filled in the case 101. At this time, the pressure of the media in the case 101 is controlled to be one atmospheric pressure by the controlling valve 105*b*. An expansion valve to have the process is set on the inlet side carrier 102*a*. The expansion valve passes through the inlet air shutter 101*a* so as to be sent into the case 101.

Inside of the seal space 20 of the expansion valve is changed with the media filled in the case 101. Thus, the inside of the seal space 20 is filled with the media. Then, the expansion valve is moved under the additive filling equipment 103 by the carrier 102*c*. The nozzle 103*a* is inserted into the hole 53*d*. The controller 103*c* controls the nozzle 103*a* to discharge liquid-phase additive, such that the amount of the additive of the seal space 20 becomes equal to the predetermined amount Ma.

At this time, the nozzle 103*a* may be lowered to a position to contact with the retainer 70 in a manner that the additive filled through the hole 53*d* is adsorbed on the retainer 70. The retainer 70 is pressed and fixed on the filling face 71*a* of the ballast member 71. The nozzle 103*a* is separated from the hole 53*d* after the predetermined amount of additive is filled. Thus, the additive filling process is finished.

Next, the carrier 102*c* sends the expansion valve under the media filling equipment 104, and the controller 104*c* controls the shield 104*a* to move downward. Therefore, airtight space is formed between the controller 104*c* and the element cover 53*c*. After the air-tightness is confirmed between the controller 104*c* and the element cover 53*c*, the nozzle 104*d* discharges gas-phase media. The discharging is continued before the seal space 20 has the predetermined amount Mr of the media. After the discharging is finished, the controller 104*c* moves the arm 104*b* downward, and the plug 53*e* is pressed into the hole 53*d*. The plug 53*e* is tightly fixed by a spot welding. Thus, the media filling process is finished.

After the media filling process is finished, the carrier 102*c* sends the expansion valve 5 toward the outlet air shutter 101*b*. The expansion valve 5 passes through the outlet air shutter 101*b*, so as to be sent out by the outlet side carrier 102*b*.

The expansion valve 5 can be produced by the above processes.

Operation of the expansion valve 5 will be described. When the compressor 2 is driven to rotate by a driving force of the vehicle engine, high-temperature and high-pressure refrigerant discharged from the compressor 2 flows into the radiator 3. In the radiator 3, heat is exchanged between the refrigerant and outside air sent by the cooling fan, such that the refrigerant condenses by emitting heat. Refrigerant flowing out of the radiator 3 is separated into gas or liquid by the receiver 4.

High-pressure liquid phase refrigerant flowing out of the receiver 4 flows into the valve chamber 51*g* through the first inlet 51*a*, and is depressurized and expanded by the throttle passage 51*h*. At this time, refrigerant passage area of the throttle passage 51*h* is controlled in a manner that the superheat degree of refrigerant flowing out of the evaporator 6 becomes close to a predetermined value.

Low-pressure refrigerant expanded by the throttle passage 51*h* flows into the evaporator 6 through the first outlet 51*b*. Refrigerant flowing into the evaporator 6 absorbs heat from air sent by the fan so as to evaporate. Further, refrigerant flowing out of the evaporator 6 flows into the expansion valve 5 through the second inlet 51*d*.

When the superheat degree of refrigerant flowing from the evaporator 6 to the communication chamber 51*i* through the second inlet 51*d* is increased, the saturated pressure of the media filled in the spaces 10, 20 is increased. Therefore, a pressure difference defined by subtracting the pressure of the introduction space 30 from the inner pressure of the space 10, 20 becomes large. Thus, the diaphragm 53*b* is displaced in a valve-opening direction (downward in FIG. 1) such that the throttle passage 51*h* is opened by the valve portion 52.

In contrast, the superheat degree of refrigerant flowing out of the evaporator 6 is decreased, the saturated pressure of the media is decreased. Therefore, the pressure difference defined by subtracting the pressure of the introduction space 30 from the inner pressure of the space 10, 20 becomes small. Thus, the diaphragm 53*b* is displaced in a valve-closing direction (upward in FIG. 1) such that the throttle passage 51*h* is closed by the valve portion 52.

The diaphragm 53*b* of the element portion 53 displaces the valve portion 52 in accordance with the superheat degree of refrigerant flowing out of the evaporator 6, thereby the passage area of the throttle passage 51*h* is controlled in a manner that the superheat degree becomes close to the predetermined value. When the load of the coil spring 54 applied to the valve portion 52 is controlled by controlling the screw 54*b*, a valve-opening pressure of the valve portion 52 can be changed so as to change the predetermined value.

Refrigerant flowing out of the second outlet 51*e* is sucked into the compressor 2 so as to be compressed again. Air sent by the non-illustrated fan is cooled in the evaporator 6, and the temperature of the air is conditioned to have a target value by a heating portion (not shown) such as a hot water heater core located at a downstream side of the evaporator 6 in an air flow direction. Thus, the conditioned air is blown toward a vehicle compartment, when air in the vehicle compartment is required to be conditioned.

Because the element portion 53 of the thermal expansion valve 5 of the present embodiment is located outside of the body portion 51, the temperature of media filled in the seal space 20 is easily influenced by the outside air temperature. For example, in winter, when the outside air temperature becomes lower than a temperature transmitted from the temperature sensing bar 52*b* and the diaphragm 53*b* to the media, the media condenses and has an over-cooled liquid state.

If the media having the over-cooled liquid phase thermally contacts liquid-phase media in the column space 10, the temperature of the media in the column space 10 is decreased. Thus, the saturated pressure of the media in the space 10, 20 is decreased. As a result, the sphere valve 52*a* is displaced in the valve-closing direction of the throttle passage 51*h*, such that the valve opening cannot have the required value. In this case, operation of the refrigeration cycle 1 may become unstable.

In contrast, in the expansion valve 5 of the present embodiment, not only the media but also the additive is filled in the seal space 20 of the element portion 53. The condensing temperature of the mixture constructed by the media and the additive can be made lower, compared with that of the media. Therefore, compared with a case in which the additive is not added, the mixture in the seal space 20 can be restricted from condensing, even when an outside air temperature is low. Further, the pressure of the seal space 20 can be made to correspond to the temperature of refrigerant flowing out of the evaporator 6. As a result, the valve portion can properly control the opening degree of the throttle passage, even when an outside air temperature is low, and malfunction of the thermal expansion valve 5 generated by the influence of the outside air temperature can be reduced.

Further, in this embodiment, the mole fraction $\eta m$ is determined so as to satisfy Formula F3, and the predetermined amount Ma of the additive is determined based on the determined mole fraction $\eta m$ and the value of the predetermined amount Mr of the media. Therefore, the condensing temperature of the mixture constructed by the media and the additive is not unnecessarily lowered in a practical range of environment temperature (outside temperature) of the refrigeration cycle 1 having the thermal expansion valve 5. Thus, a volume ratio of the media to the space 20, 10 is not unnecessarily lowered. Therefore, accuracy for filling the media in the space 20 can be improved.

Further, in this embodiment, a process of producing the thermal expansion valve 5 has the additive filling process and the media filling process. That is, the element portion 53 is produced by filling the additive into the seal space 20 and by filling the media into the seal space 20. When the predetermined amount of liquid phase additive is filled in the seal space 20, the seal space 20 is filled with the gas phase media having the temperature and the pressure to make the additive to have the liquid phase. Further, the predetermined amount of the media is filled in the seal space 20, after the additive is filled in the seal space 20. Therefore, a proper amount of additive can be filled in the seal space 20, even when volatile additive such as ethanol is used. Thus, the condensing temperature of the mixture constructed by the media and the additive can be lowered, compared with the condensing temperature of the media.

Further, in this embodiment, because the thermal expansion valve 5 includes the additive retainer 70, the additive can be temporally retained in the producing process of the expansion valve 5. Therefore, the additive can be restricted from leaking from the seal space 20, even when vibration is generated while the expansion valve 5 is carried in the producing process.

Further, in this embodiment, because the thermal expansion valve 5 includes the heat insulation member 60 and the ballast member 71, a speed of transmitting heat from the temperature sensing bar 52*b* to the mixture of the media and the additive can be delayed. Therefore, rapid displacement of the valve portion 52*a* can be restricted, such that unstable operation (hunting phenomenon) of the refrigeration cycle 1 can be reduced.

Second Embodiment

In the first embodiment, ethanol corresponding to the liquid phase additive is filled in the seal space in the additive filling process, in a state that the seal space is filled with the media. After the additive filling process, the media filling process is performed so as to fill the gas phase media in the seal space. In a second embodiment, silicon oil is used as a liquid phase additive. Further, gas in the seal space is vacuumed in a gas vacuum process, after the additive filling process. The media filling process is performed after the gas vacuum process. A construction of a thermal expansion valve 5 of the second embodiment is similar to that of the first embodiment.

Figure 4:
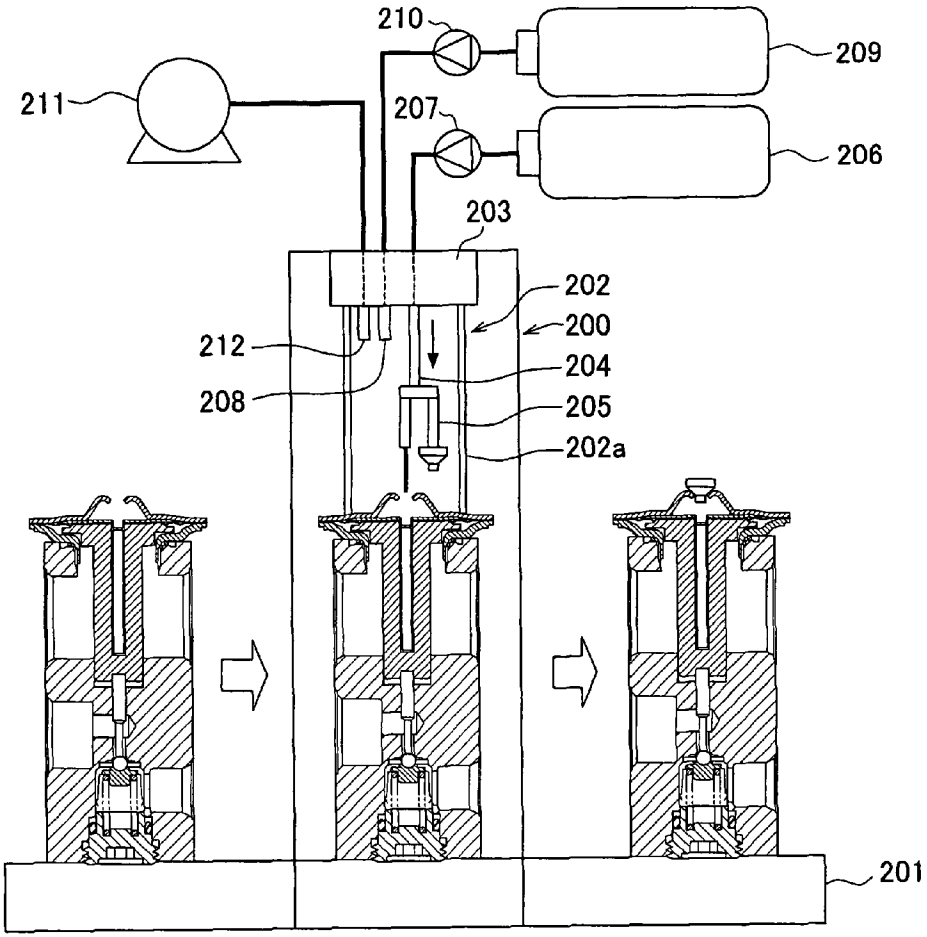
FIG. 4 is a diagram illustrating a producing process of the thermal expansion valve of the second and third embodiments.

A process for producing the expansion valve 5 of the present embodiment will be described with reference to FIG. 4. FIG. 4 shows a process of filling media and additive into a seal space 20.

Equipment 200 used for the filling process will be descried. The equipment 200 includes a carrier 201 to carry an expansion valve, and a cylinder 202. An additive filling process, a gas vacuum process, and a media filling process are changeable by the cylinder 202.

The cylinder 202 has a cylinder-shaped shield 202*a* tightly contacting with the element cover 53*c*. A non-illustrated gasket is mounted between the shield 202 and the element cover 53*c*. A controller 203 is arranged on the shield 202*a*, and controls a flowing amount and a pressure of media or additive. The shield 202*a* maintains air-tightness between the element cover 53*c* and the controller 203. The shield 202*a* is able to extend or shrink in the up-and-down direction due to the controller 203. The shield 202*a* can tightly contact with the element cover 53*c*, and can be separated from the element cover 53*c* after the filling process is finished, because the shield 202*a* can extend or shrink in the up-and-down direction.

An arm 204 is arranged in the shield 202*a*. The arm 204 moves downward from the controller 203. A plug pressing shaft 205 and an additive filling nozzle 206 are mounted on an end of the arm 204. The shaft 205 presses the sealing plug 53*e* into the hole 53*d*, and tightly fixes the plug 53*e* by spot welding so as to seal the hole 53*d*. The nozzle 206 is inserted into the hole 53*d*, and injects the additive into the seal space 20. A rotation of the arm 204 can changeably make the shaft 205 or the nozzle 206 to be located above the hole 53*d*. An additive tank 213 is connected to the nozzle 206 through the controller 203. An additive pump 207 is arranged between the controller 203 and the tank 213. The pump 207 sucks the additive filled in the tank 213, and pressurizes the additive for the controller 203.

A media nozzle 208 to inject media is arranged in the shield 202*a*. A media tank 209 is connected to the nozzle 208 through the controller 203. A media pump 210 is arranged between the controller 203 and the tank 209. The pump 210 sucks the media filled in the tank 209, and pressurizes the media for the controller 203.

Further, a vacuum nozzle 212 is arranged in the shield 202*a*, and is connected to a vacuum pump 211. The pump 211 vacuums gas in the shield 202*a*.

A filling and sealing process using the equipment 200 will be described. An expansion valve is sent into the cylinder 202 by the carrier 201. The controller 203 controls the shield 202*a* to move downward, thereby airtight space can be formed between the controller 203 and the element cover 53*c*. After the air-tightness between the controller 203 and the element cover 53*c* is confirmed, the arm 204 is moved downward. At this time, the end of the arm 204 is rotated, thereby the nozzle 206 is set above the hole 53*d*. The end of the nozzle 206 is inserted into the hole 53*d*. The controller 203 controls the nozzle 206 to inject the liquid phase additive, such that the space 20 has the predetermined amount Ma of the additive. The predetermined amount Ma of the present embodiment is determined to satisfy Formula F3 described in the first embodiment. Further, the end of the nozzle 206 may be lowered to a position to contact with the retainer 70 in a manner that the additive filled through the hole 53*d* is adsorbed on the retainer 70. The retainer 70 is pressed and fixed on the filling face 71*a* of the ballast member 71. The nozzle 206 is moved upward after the predetermined amount of the additive is filled in the seal space 20. Thus, the additive filling process is finished.

Next, the gas vacuum process is performed so as to vacuum gas from the seal space 20. Specifically, gas in the cylinder 202 is vacuumed through the nozzle 212 by activating the pump 211, such that the cylinder 202 has a low vacuum state having a pressure equal to or lower than $10^{-3}$ Pa. After the cylinder 202 is confirmed to have the pressure equal to or lower than $10^{-3}$ Pa, the pump 211 is stopped. The pump 211 may be a dry pump in which oil is not used for a drawing mechanism so as to restrict oil contamination of the seal space 20.

Next, the media filling process is performed so as to fill the gas phase media into the seal space 20. Specifically, the controller 203 controls the nozzle 208 to inject the media in a state that the airtightness is maintained between the controller 203 and the element cover 53*c*. The filling of the media is continued before the seal space 20 has a predetermined amount of the media, such that the condensing temperature of the mixture constructed by the media and the additive has a predetermined value. After the filling of the media is finished, the controller 203 lowers the arm 204, and presses the plug 53*e* into the hole 53*d*. The plug 53*e* is fixed by a spot welding so as to seal the hole 53*d*. Thus, the media filling process is finished. After the media filling process is finished, the carrier 201 sends out the expansion valve 5.

Thus, the expansion valve 5 can be produced.

In this embodiment, inside of the seal space 20 is depressurized to have the pressure equal to or lower than $10^{-3}$ Pa, after the additive is filled in the seal space 20. Therefore, the additive is required to be a material difficult to evaporate under the pressure of $10^{-3}$ Pa. Thus, in this embodiment, silicon oil is used as the additive. The silicon oil is used for lubricating the compressor 2 of the refrigeration cycle 1.

In this embodiment, not only the media but also the additive is filled in the seal space 20 of the element portion 53. Therefore, similarly to the first embodiment, malfunction of the thermal expansion valve generated by the influence of the outside air temperature can be reduced. Further, because the mole fraction ηm is determined so as to satisfy Formula F3, the condensing temperature of the mixture constructed by the media and the additive is not unnecessarily lowered.

Further, in this embodiment, the thermal expansion valve 5 is produced by the additive filling process, the gas vacuum process and the media filling process. That is, the element portion 53 is produced by filling the predetermined amount of the liquid-phase additive into the seal space 20, by vacuuming the gas in the seal space 20, and by filling the predetermined amount of the media into the seal space 20. Further, because the non-Volatile additive is used, a proper amount of additive can be filled in the seal space 20. The non-volatile additive is difficult to evaporate when a negative, pressure is generated. Therefore, the condensing temperature of the mixture constructed by the media and the additive can be properly lowered, compared with the condensing temperature of the media.

Further, in this embodiment, similarly to the first embodiment, the additive can be retained due to the additive retainer 70, and the hunting phenomenon can be reduced due to the ballast member 71 and the heat insulation member 60 located in the column space 10.

Third Embodiment

In the first embodiment, the liquid phase additive is filled in the seal space in the additive filling process, in a state that the seal space is filled with the gas phase media. After the additive filling process, gas phase media is filled in the seal space in the media filling process. In a third embodiment, gas in the seal space is vacuumed in a gas vacuum process. After the gas vacuum process, the gas phase media is filled in the seal space in a media filling process. After the media filling process, the liquid phase additive is filled in the seal space in an additive filling process. A construction of a thermal expansion valve 5 of the third embodiment is similar to that of the first embodiment of FIG. 1.

A process for producing the expansion valve 5 of the present embodiment will be described with reference to FIG. 4. FIG. 4 shows a process of filling media and additive into a seal space 20. The filling process is performed by using equipment 200, similarly to the second embodiment.

An expansion valve is sent under a cylinder 202 by a carrier 201. A controller 203 controls a shield 202*a* to move downward, thereby airtight space can be formed between the controller 203 and the element cover 53*c*.

Next, the gas vacuum process is performed so as to vacuum gas from the seal space 20. Specifically, gas in the cylinder 202 is vacuumed through the nozzle 212 by activating the pump 211, such that the cylinder 202 has a low vacuum state having a pressure equal to or lower than $10^{-3}$ Pa. After the cylinder 202 is confirmed to have the pressure equal to or lower than $10^{-3}$ Pa, the pump 211 is stopped.

Next, the media filling process is performed so as to fill the gas phase media into the seal space 20. Specifically, the controller 203 controls the nozzle 208 to inject the media, in a state that the air-tightness is maintained between the controller 203 and the element cover 53*c*. The filling of the media is continued before the seal space 20 has a predetermined amount of the media, such that the condensing temperature of the mixture constructed by the media and the additive has a predetermined value. Thus, the media filling process is finished.

Next, the additive filling process is performed so as to fill the liquid phase additive into the seal space 20. Specifically, the arm 204 is moved downward in a state that the air-tightness is maintained between the controller 203 and the element cover 53*c*. At this time, the end of the arm 204 is rotated, thereby the nozzle 206 is set above the hole 53*d*. The end of the nozzle 206 is inserted into the hole 53*d*. The controller 203 controls the nozzle 206 to inject the liquid phase additive, such that the predetermined amount of ethanol ($C_2H_6O$) is filled in the seal space 20 as the liquid phase additive. Further, the end of the nozzle 206 may be lowered to a position to contact with the retainer 70 in a manner that the additive filled through the hole 53*d* is adsorbed on the retainer 70. The retainer 70 is pressed and fixed on the face 71*a* of the ballast member 71. The nozzle 206 is moved upward after the predetermined amount of the additive is filled. Thus, the additive filling process is finished.

After the filling of the media and the additive is finished, the controller 203 lowers the arm 204, and presses the plug 53*e* into the hole 53*d*. The plug 53*e* is fixed by a spot welding so as to seal the hole 53*d*. After the filling process is finished, the carrier 201 sends out the expansion valve 5.

Thus, the expansion valve 5 can be produced.

In this embodiment, not only the media but also the additive is filled in the seal space 20 of the element portion 53. Therefore, similarly to the first embodiment, malfunction of the thermal expansion valve generated by the influence of the outside air temperature can be reduced. Further, because the mole fraction ηm is determined so as to satisfy Formula F3, the condensing temperature of the mixture constructed by the media and the additive is not unnecessarily lowered.

Further, in this embodiment, the thermal expansion valve 5 is produced by the gas vacuum process, the media filling process, and the additive filling process. That is, the element portion 53 is produced by vacuuming gas from the seal space 20, by filling the predetermined amount of the gas phase media into the vacuumed seal space 20, and by filling the predetermined amount of the liquid-phase additive into the seal space 20. Therefore, even if an easily-evaporating material is used as the additive, a proper amount of the additive can be filled in the seal space 20. Therefore, the condensing temperature of the mixture constructed by the media and the additive can be properly lowered, compared with the condensing temperature of the media.

Further, in this embodiment, similarly to the first embodiment, the additive can be retained due to the additive retainer 70, and the hunting phenomenon can be reduced due to the ballast member 71 and the heat insulation member 60 in the column space 10.

Fourth Embodiment

In the first embodiment, the column space 10 is defined in the temperature sensing bar 52*b* so as to extend in the axis direction of the bar 52*b*. In a fourth embodiment, the column space 10 has an upper space part located adjacent to the pressure responding member 53*b* and a lower space part located adjacent to the valve portion 52*a*. Further, an inner diameter of the lower space part is smaller than that of the upper space part. In the first embodiment, the heat insulation member 60 is mounted on the inner wall face of the column space 10, and the retainer 70 is arranged on the filling face of the ballast member 71. In the present embodiment, only the heat insulation member 60 is mounted on the inner wall face of the column space 10. Other parts except for the described differences are the same as the first embodiment.

Figure 5:
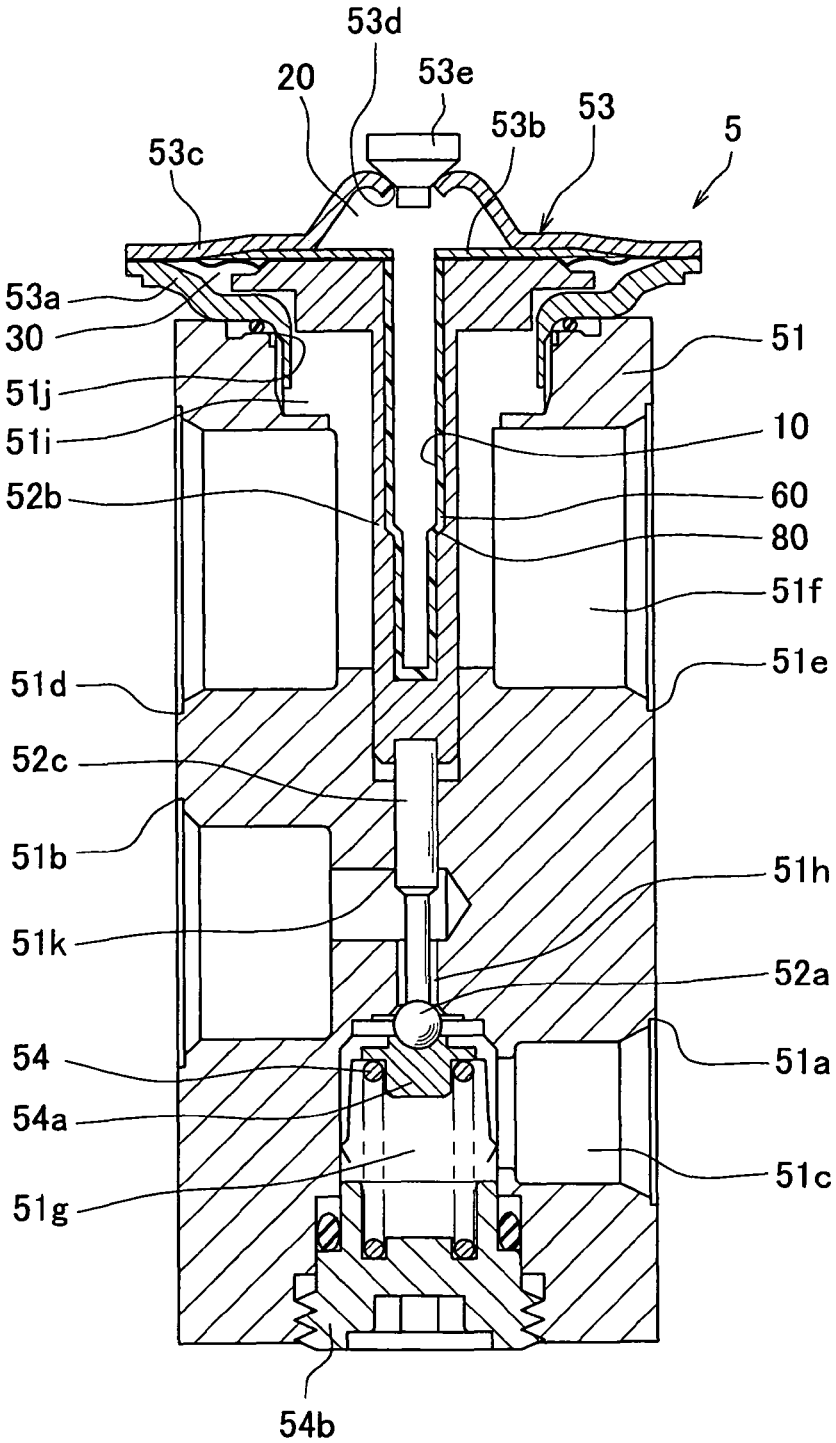
FIG. 5 is a cross-sectional view illustrating a thermal expansion valve according to a fourth embodiment.

The column space 10 of the present embodiment will be described with reference to FIG. 5. FIG. 5 shows a cross-sectional view of the thermal expansion valve 5 of the present embodiment.

The column space 10 is defined in the temperature sensing bar 52*b* so as to extend in the axis direction of the bar 52*b*. A small diameter part 80 is defined at a position of the column space 10 departing from the element portion 53 in the longitudinal direction. An inner diameter of the column space 10 is changed at the small diameter part 80. Opposite part of the column space 10 opposite from the element portion 53 with respect to the small diameter part 80 has a diameter smaller than that of the column space 10 located adjacent to the element portion 53.

The heat insulation member 60 made of resin is fitted and pressed into the column space 10. A shape of the heat insulation member 60 is changeable in accordance with the change of the inner diameter of the column space 10, such that the heat insulation member 60 tightly contacts with the inner wall face of the column space 10.

In this embodiment, not only the media but also the additive is filled in the seal space 20 of the element portion 53. Therefore, similarly to the first embodiment, malfunction of the thermal expansion valve generated by the influence of the outside air temperature can be reduced. Further, the hunting phenomenon can be reduced due to the heat insulation member 60.

Further, in the present embodiment, because the heat insulation member 60 is arranged inside of the temperature sensing bar 52*b*, the hunting phenomenon generated by a rapid changing of refrigerant temperature can be reduced. Further, the inner diameter of the column space 10 is not constant, due to the small diameter part 80. A speed of transmitting heat from the sensing bar 52*b* to the mixture of the media and the additive can be delayed by the small diameter part 80. Therefore, the hunting phenomenon generated by the rapid changing of refrigerant temperature can be much reduced.

Fifth Embodiment

Figure 6:
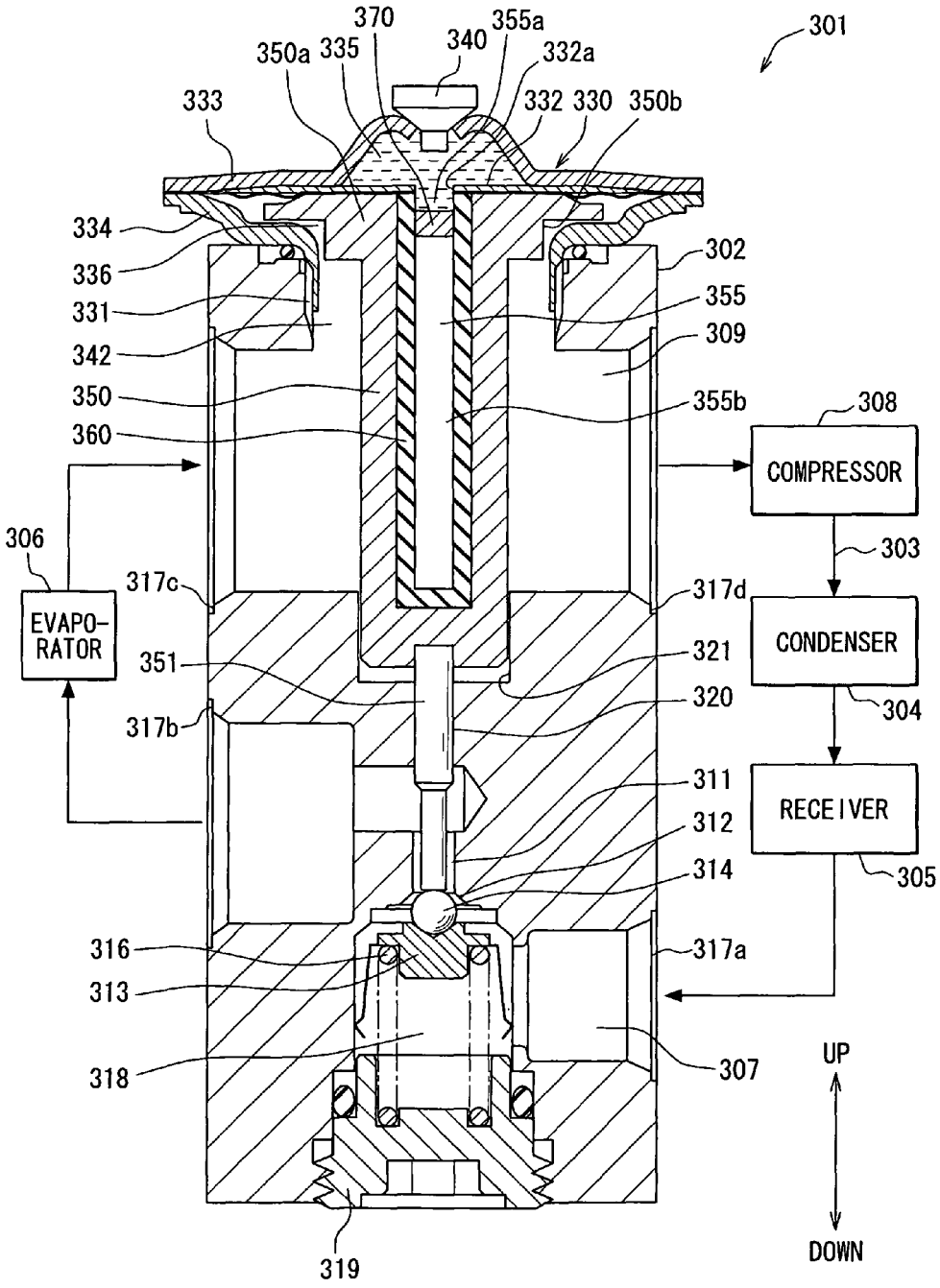
FIG. 6 is a cross-sectional view illustrating an expansion valve according to a fifth embodiment.
Figure 7:
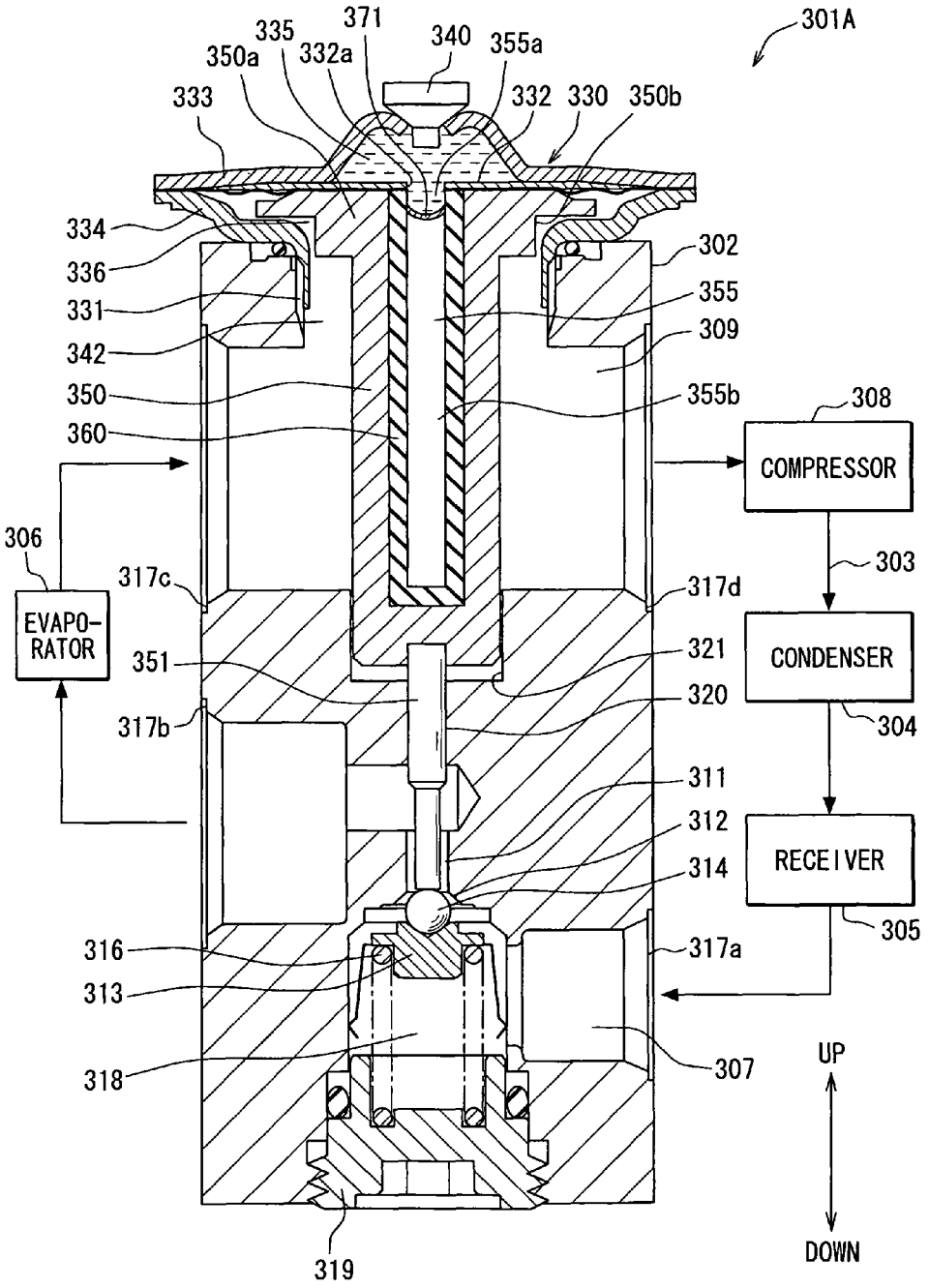
FIG. 7 is a cross-sectional view illustrating a modification example of the expansion valve.

A fifth embodiment will be described with reference to FIG. 6 and FIG. 7, as an example of an expansion valve according to the present invention. The expansion valve is a thermal expansion valve corresponding to a depressurizing device used in a refrigeration cycle of an air-conditioning apparatus for a vehicle, for example. FIG. 6 is a schematic longitudinal cross-sectional view illustrating an expansion valve 301 of the fifth embodiment together with constructions of the refrigeration cycle.

As shown in FIG. 6, the expansion valve 301 has a rectangular column shaped body portion 302 made of aluminum. The body portion 302 has a first passage 307 through which liquid phase refrigerant passes. The first passage 307 is a part of a refrigerant passage 303 through which refrigerant (such as R134a) of the refrigeration cycle passes. The first passage 307 extends between an outlet of a condenser 304 and an inlet of an evaporator 306, and a receiver 305 is arranged between the condenser 304 and the first passage 307. The body portion 302 has a second passage 309 through which low-pressure gas phase refrigerant (low-pressure refrigerant) passes. The second passage 309 extends between an outlet of the evaporator 306 and an inlet of a compressor 308. The passages 307, 309 are distanced from each other in an up-and-low direction.

An orifice 311 is defined in the first passage 307 so as to perform adiabatic expansion of liquid refrigerant supplied from the outlet of the receiver 305. The orifice 311 is a narrow part having a small cross-sectional area in the first passage 307, and is located to extend in an axis direction of a valve portion 314. A valve seat 312 is arranged at an inlet of the orifice 311, and the valve portion 314 supported by a valve member 313 is seated on or separated from the seat 312. An amount of refrigerant passing through the orifice 311 is controlled by controlling a dimension between the valve portion 314 and the valve seat 312.

The valve portion 314 and the valve member 313 are fixed with each other by welding. The valve member 313 is biased by a compression coil spring 316 in a direction of pressing the valve portion 314 toward the valve seat 312. The spring 316 corresponds to a biasing portion to bias the valve member 313 and the valve portion 314, and the valve portion 314 is biased in a direction of closing the orifice 311.

The first passage 307 is defined from a first inlet 317*a* to a first outlet 317*b*. Liquid refrigerant is introduced into the first inlet 317*a* from the receiver 305. A valve chamber 318 communicating with the first inlet 317*a* is defined in the first passage 307. The valve chamber 318 has the same axis as the orifice 311, and is defined by a based space closed by a plug 319 from a lower side.

Further, the body portion 302 has a small diameter hole 320 and a large diameter hole 321. A diameter of the large diameter hole 321 is larger than that of the small diameter hole 320. The hole 320, 321 communicate with the second, passage 309 in the same axis as the orifice 311, and is defined by a tube shaped space extending in the up-and-down direction. A lower part of a temperature sensing bar 350 is located in the large diameter hole 321. An operation bar 351 is located to pass through the small diameter hole 320, and directly contacts with the lower part of the temperature sensing bar 350.

A screw hole 331 is defined in an upper end part of the body portion 302, and a power element 330 corresponding to a heat sensing portion is mounted in the hole 331. The power element 330 includes a diaphragm 332 made of stainless steel, a first cover 333, and a second cover 334. The covers 333, 334 tightly contact with each other through the diaphragm 332.

When the integrated covers 333, 334 are mounted to the body portion 302, a first pressure-responding chamber and a second pressure-responding chamber are defined in the power element 330 so as to be separated through the diaphragm 332. An upper pressure-responding chamber 335 corresponding to the first chamber is an airtight chamber located on a top face of the diaphragm 332. A lower pressure-responding chamber 336, corresponding to the second chamber is an airtight chamber located under the diaphragm 332. The first cover 333 has a sealing plug 340 (sealing member) to seal fluid in the upper chamber 335, and the fluid drives the diaphragm 332.

The lower chamber 336 communicates with the second passage 309 through a pressure constant hole 342, and the hole 342 is concentrically formed with respect to the center axis of the orifice 311. The second passage 309 is defined from a second inlet 317*c* to a second outlet 317*d*, and gas phase refrigerant (low-pressure refrigerant) flowing out of the evaporator 306 passes through the second passage 309. The temperature sensing bar 350 is arranged to cross the second passage 309. The gas phase refrigerant flowing out of the evaporator 306 passes through the second passage 309, and a pressure of the gas phase refrigerant is applied to the lower chamber 336 through the hole 342. The lower chamber 336 and the hole 342 communicate with each other through a clearance defined around an umbrella part 350*b* of the sensing bar 350 (gap defined between the umbrella part 350*b* and the second cover 334).

Further, the bars 350, 351 made of stainless steel are located in a space defined from the lower chamber 336 to the small diameter hole 320 through the second passage 309. The temperature sensing bar 350 is a bar-shaped member constructing a stem, and a first end 350*a* of the sensing bar 350 in the axis direction contacts with the diaphragm 332. Further, a second end of the bar 350 in the axis direction is located to pass through the second passage 309 and to be slidable (movable with sliding) in the axis direction of the large diameter hole 321.

At least a part of the sensing bar 350 is located in the second passage 309, so as to sense a temperature of low-pressure refrigerant flowing through the second passage 309. That is, the sensing bar 350 transmits the temperature of refrigerant at the outlet of the evaporator 306 to the upper chamber 335. Further, the sensing bar 350 slides in the large diameter hole 321 in accordance with a displacement of the diaphragm 332, when the diaphragm 332 is displaced by a pressure difference of the chambers 335, 336. Thus, a driving force can be provided to the valve portion 314. The operation bar 351 integrated with the temperature sensing bar 350 is located to be slidable in the small diameter hole 320. The operation bar 351 directly applies an opposing force to the valve portion 314 in accordance with the displacement of the sensing bar 350, and the opposing force corresponds to an elastic force of the spring 316.

The sensing bar 350 contacts with the operation bar 351, and the operation bar 351 contacts with the valve portion 314. The bars 350, 351 correspond to a valve driving bar to drive the valve portion 314. The valve driving bar is concentrically arranged in the hole 342, and extends from a lower face of the diaphragm 332 to the orifice 311 through the second passage 309.

The sensing bar 350 has a tube-shaped inner space 355 extending in the axis direction. An upper side (first side) of the tube space 355 is opened, and a lower side (second side) of the tube space 355 is closed. Thus, the tube space 355 is defined to be a based container. The opening of the upper side (first side) corresponds to an opening 332*a* of the diaphragm 332, and the tube space 355 communicates with the upper chamber 335 through the opening 332*a*.

A heat conductivity low layer 360 having a predetermined thickness is arranged around a whole inner wall of the tube space 355. Therefore, heat transmission performed by an inner circumference face of the sensing bar 350 is lower than that performed by an outer circumference face of the sensing bar 350. The layer 360 is made of a material having a heat conductivity lower than that of a material forming the sensing bar 350. For example, the layer 360 may be made of a variety of resin. When the layer 360 is made of resin, the layer 360 can be easily produced by using an insert molding, for example, such that the productivity can be increased.

A piston 370 is arranged in the tube space 355 so as to separate the tube space 355 into two spaces, and slidably moves in the axis direction of the tube space 355. The piston 370 restricts fluids filled in the two separated spaces from mixing with each other, and slides in the axis direction of the tube space 355 in accordance with a pressure difference of the two spaces.

A first space 355*a* of the two spaces includes the upper chamber 335, and incompressible fluid is filled in the first space 355*a* so as to drive the diaphragm 332. A volume, change or density change of the incompressible fluid is relatively small, even when a pressure variation is generated. When the expansion valve 301 is used at a temperature of −30° C.~60° C., the incompressible fluid has a certain level of volume change, but does not have a phase change. For example, the incompressible fluid may be compressor oil such as PGA oil for R134a, fluorinated oil, or silicon oil.

A second space 355*b* of the two spaces is located opposite from the upper chamber 335. Gas phase refrigerant is filled in the sealed second space 355*b*. Because the second space 355*b* is located to correspond to the second passage 309, heat of low-pressure refrigerant flowing through the second passage 309 out of the evaporator 306 is transmitted to the gas phase refrigerant (hereinafter may be defined as gas refrigerant) filled in the second space 355*b*.

The piston 370 has a shape corresponding to an inner wall face of the tube space 355, for example. A clearance is defined between the inner wall face of the tube space 355 and an outer circumference face of the piston 370; in a manner that the incompressible fluid of the first space 355*a* and the gas refrigerant of the second space 355*b* are restricted from leaking from the clearance. Further, the piston 370 is made of a material, which does not allow the fluid and the refrigerant to pass through.

In a refrigeration cycle having the expansion valve 301, when the compressor 308 is activated, refrigerant starts to flow. At this time, the expansion valve 301 operates as a decompressing device, and refrigerant flows in the first and second passages 307, 309.

Heat of low-pressure refrigerant flowing through the second passage 309 is transmitted to gas refrigerant in the tube space 355, thereby a pressure of the gas refrigerant is varied. Further, the heat is transmitted to the lower chamber 336 communicating with the second passage 309. The pressure of the gas refrigerant in the tube space 355 is applied to the incompressible fluid of the upper chamber 335 through the piston 370. A pressure of the incompressible fluid is applied to a top face of the diaphragm 332 in accordance with the applied pressure. The diaphragm 332 is displaced upward or downward by a difference between the pressure applied to the top face from the incompressible fluid and a pressure applied to the lower face (that is, the pressure of the lower chamber 336 (the pressure of the gas refrigerant flowing into the inlet of the compressor 308 from the outlet of the evaporator 306)).

The displacement of the diaphragm 332 is transmitted to the valve portion 314 through the bars 350, 351. The valve portion 314 is moved toward or separated from the valve seat 312 of the orifice 311. As a result, an amount of refrigerant flowing through the first passage 307 can be controlled. Thus, thermal energy of the gas phase refrigerant adjacent to the outlet of the evaporator 306 is transmitted in a route constructed by the sensing bar 350, the heat conductivity low layer 360, the gas phase refrigerant in the tube space 355 and the incompressible fluid, in this order. A pressure difference between the gas phase refrigerant and the incompressible fluid is applied to the diaphragm 332. A displacement of the valve portion 314 is determined by the displacement of the diaphragm 332. Thus, an amount of decompressing refrigerant by the expansion valve 301 can be controlled.

For example, when outlet temperature of the evaporator 306 is increased (when a superheat degree of outlet refrigerant is increased), the pressure of the upper chamber 335 is raised. The diaphragm 332 is displaced downward in accordance with the raising of the pressure of the upper chamber 335. Thus, the valve portion 314 is moved downward by the bars 350, 351, such that the opening degree of the orifice 311 is increased. Therefore, an amount of refrigerant supplied to the evaporator 306 is increased, and a temperature of the evaporator 306 is lowered. In contrast, when the outlet temperature of the evaporator 306 is decreased (when the superheat degree of the outlet refrigerant is decreased), the valve portion 314 is driven in the opposite direction, and the opening degree of the orifice 311 becomes small. Therefore, the amount of refrigerant supplied to the evaporator 306 is decreased, and the temperature of the evaporator 306 is raised.

Thus, the valve portion 314 is displaced in accordance with the superheat degree of refrigerant flowing through the outlet of the evaporator 306. Therefore, the cross-sectional area of the orifice 311 can be controlled in a manner that the superheat degree of refrigerant flowing through the outlet of the evaporator 306 becomes close to a predetermined value. Further, a load applied to the valve portion 314 by the spring 316 is controlled by controlling a tightness of the plug 319. Thus, the predetermined value of the superheat degree can be controlled.

Next, an expansion valve 301A will be described, as a modification example of the expansion valve 301. FIG. 7 shows a longitudinal cross-sectional view of the expansion valve 301A. As shown in FIG. 7, the expansion valve 301A includes a shape-changeable member 371 in place of the piston 370. A position of the shape-changeable member 371 is fixed, and a shape of the shape-changeable member 371 is changeable. The shape-changeable member 371 is fixed around an inner wall of the tube space 355, and separates the tube space 355 into two spaces. A shape of the shape-changeable member 371 is flexibly changed by a pressure difference. Similarly to the piston 370, the shape-changeable member 371 restricts fluids filled in the two spaces from mixing with each other. A circumference part of the shape-changeable member 371 is fixed around the inner wall of the tube space 355, and is not displaced by the pressure difference between the incompressible fluid and the gas refrigerant. An approximately center part of the shape-changeable, member 371 is deformed and displaced, thereby heat of refrigerant passing through the second passage 309 can be transmitted as a pressure. The shape-changeable member 371 has a thin membrane shape, for example, and is made of a material not allowing the fluid and the refrigerant to pass through. For example, the shape-changeable member 371 is made of natural rubber or synthetic rubber such as polyurethane.

Operations and advantages of the expansion valve of the present embodiment will be described. The expansion valve 301 includes the heat conductivity, low layer 360 and the piston 370. The layer 360 is arranged around the inner wall of the tube space 355, and has a heat conductivity lower than that of a member constructing the temperature sensing bar 350. The piston 370 separates the tube space 355 into two spaces, and slidably moves on the inner wall in the axis direction of the tube space 355. The two spaces correspond to the first space 355*a* and the second space 355*b*. The incompressible fluid is filled in the first space 355*a* located adjacent to the upper chamber 335. A volume change of the incompressible fluid generated by a pressure variation is small. The gas phase refrigerant is filled in the second space 355*b* located in the second passage 309 opposite from the upper chamber 335.

Following, advantages can be obtained due to the above construction. Due to the heat conductivity low layer 360, time constant of heat transmission can be made larger. The heat transmission is defined to transmit heat of refrigerant flowing through the outlet of the evaporator 306 to temperature sensing refrigerant (the gas refrigerant). Thus, time constant effective for restricting a hunting phenomenon can be easily secured. Further, due to the piston 370, a predetermined amount of the incompressible fluid and a predetermined amount of the gas refrigerant are separately filled in the two spaces without considering resolvability relative to each other. Further, a gas-charged expansion valve can be provided, in which the gas phase refrigerant is filled in the second space 355*b*. Cost and man-hour for producing the gas-charged expansion valve are lower than those for producing a liquid-charged or adsorbent-charged expansion valve. Thus, the productivity can be improved.

The piston 370 has a displacement amount corresponding to a displacement amount of an interface between the incompressible fluid and the gas phase refrigerant. The displacement amount of the piston 370 generated by a volume change of the incompressible fluid is sufficiently smaller than that generated by a displacement of the diaphragm 332. The first space 335*a* is easily affected by atmospheric temperature. However, a volume change of the first space 355*a* is small, when the incompressible fluid is filled in the first space 355*a*. Therefore, disadvantage of malfunction can be eliminated. In a comparison example, the malfunction is generated by a condensing of temperature sensing fluid at an upper part of the power element 330 at a low temperature time. Thus, the gas-charged expansion valve having the better productivity can be provided, and influence of the atmospheric temperature can be eliminated relative to the operation of the expansion valve.

Following advantages can be provided for the expansion valve 301A in addition to the advantages of the expansion valve 301. The shape-changeable member 371 of the expansion valve 301A is deformed in accordance with the pressure difference between the gas refrigerant and the incompressible fluid. Therefore, a construction of the expansion valve 301A is simple, compared with that of the expansion valve 301 having the piston 370 sliding in the tube space 355.

Gas phase refrigerant is filled in the temperature sensing portion of the gas-charged expansion valve 301, 301A without using adsorbent such as activated carbon. Therefore, MOP characteristic can be provided for the expansion valve 301, 301A, in which sealed refrigerant becomes heated gas at a set temperature.

Sixth Embodiment

Figure 8:
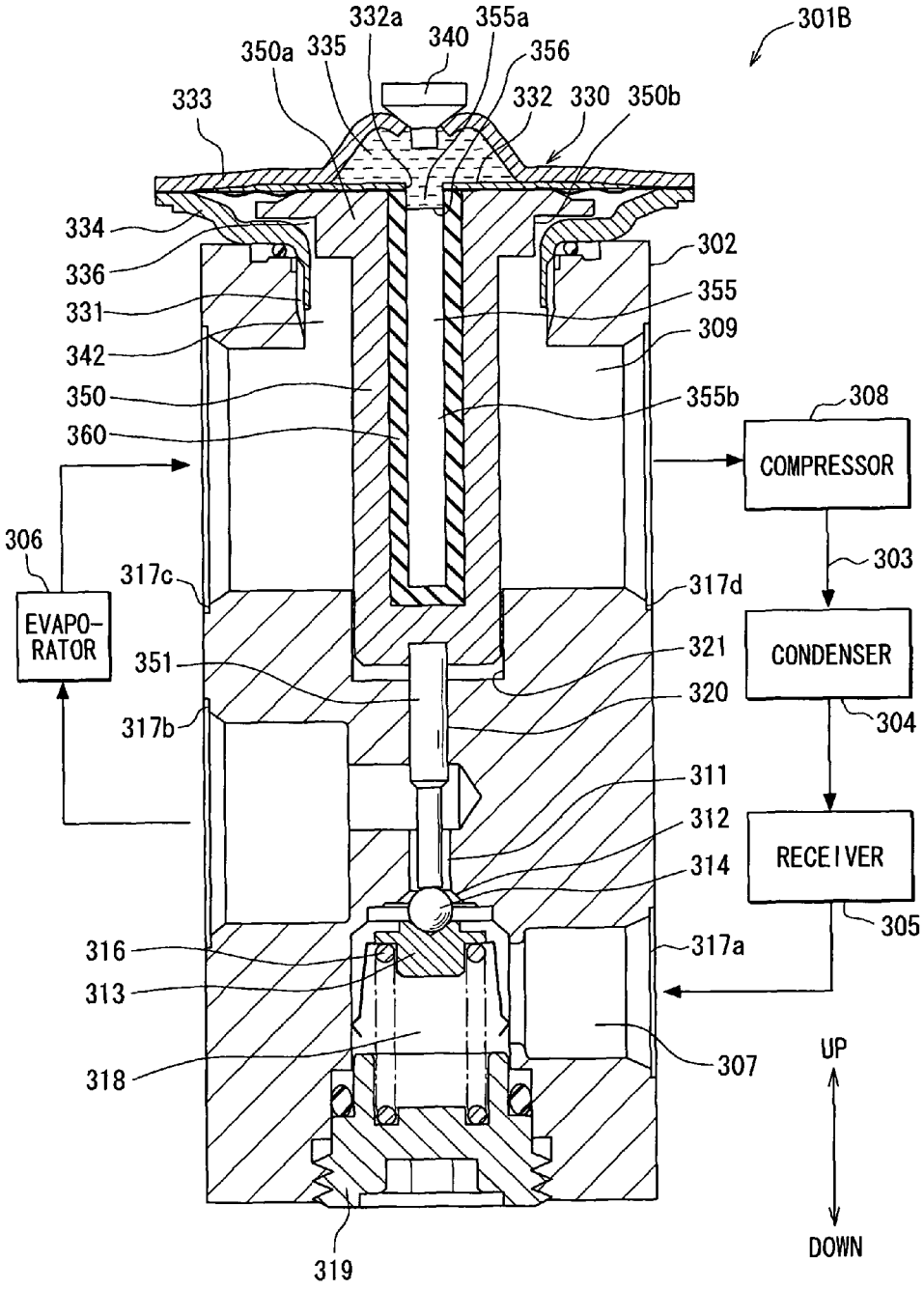
FIG. 8 is a cross-sectional view illustrating an expansion valve according to a sixth embodiment.
Figure 9:
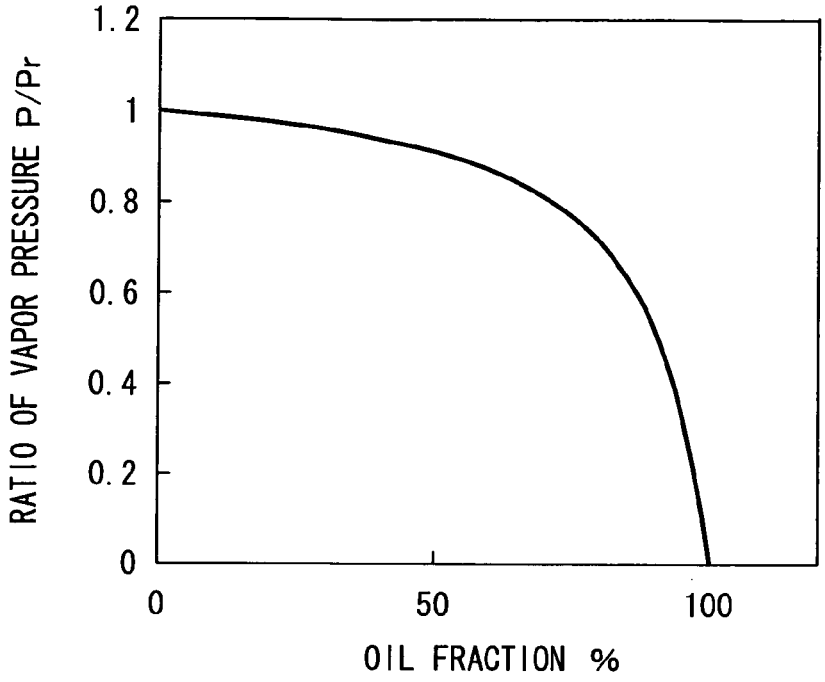
FIG. 9 is a characteristic diagram illustrating an example of compatibility between incompressible fluid and gas phase refrigerant filled in the expansion valve.
Figure 10:
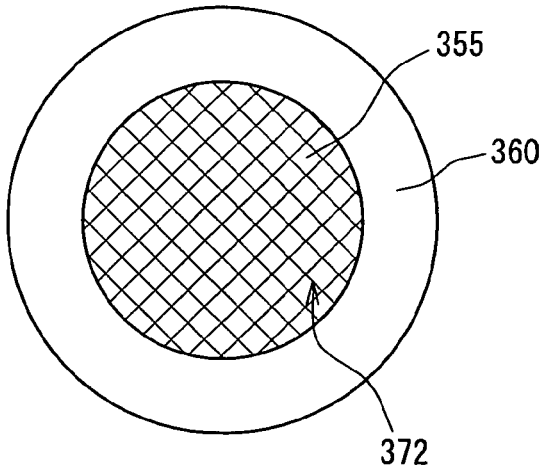
FIG. 10 is a plan view illustrating a surface tension raising portion arranged on an interface between the incompressible fluid and the gas phase refrigerant.

An expansion valve 301B of a six embodiment will be described with reference to FIGS. 8-10. FIG. 8 shows a longitudinal cross-sectional view of the expansion valve 301B of the sixth embodiment. A member of FIG. 8 having the same reference number as the fifth embodiment is the same member having the same functions and advantages.

As shown in FIG. 8, the expansion valve 301B of the present embodiment is different from the expansion valve 301, 301A in a point not having the piston 370 or the shape-changeable member 371 separating the tube space 355.

Therefore, the incompressible fluid and the gas refrigerant maintain a balance therebetween at an interface 356. Further, the expansion valve 301B is defined in a manner that a drag force restricting the incompressible fluid from falling in a lower part of the tube space 355 (hereinafter may be defined as a drag force caused by a surface tension) becomes larger than a gravity of the incompressible fluid applied to the interface 356.

The expansion valve 301B is produced to satisfy following Formula 1, so as to make the drag force caused by the surface tension larger than the gravity of the incompressible fluid. The tube space 355 is defined to have a diameter of $\phi$ in an axis direction cross-section. The incompressible fluid is defined to have a height of h in a vertical direction upward from the interface 356, a density of $\rho$, and a surface tension of S at the interface 356. Circle ratio is defined as $\pi$, and gravity acceleration is defined as g.

$$\phi \cdot S \geq (\phi/2)^2 \cdot h \cdot \rho \cdot g \quad \text{(Formula 1)}$$

is defined when the axis direction cross-section of the interface 356 of the tube space 355 has a round shape.

In a case that the axis direction cross-section of the interface 356 of the tube space 355 has a rectangular shape, the expansion valve 301B is produced to satisfy following Formula 2. The axis direction cross-section of the tube space 355 is defined to have a longitudinal dimension of L1 and a transversal dimension of L2.

$$\{2 \cdot (L1+L2)/\pi\} \cdot S \geq L1 \cdot L2 \cdot h \cdot \rho \cdot g \quad \text{(Formula 2)}$$

is defined. The part of $\{2(L1+L2)/\pi\}$ of Formula 2 represents a diameter of a circle corresponding to the rectangular shape having the same wetted perimeter.

Thus, the expansion valve 301B is produced in a manner that Formula 1 and Formula 2 are satisfied by dimensions of parts, an amount of the incompressible fluid and an amount of the gas phase refrigerant.

Further, in a case that the incompressible fluid and the gas refrigerant have a relationship of resolving characteristic relative to each other (hereinafter may be defined as a compatibility) at a predetermined ratio, the expansion valve 301B is produced by considering a level of the compatibility so as to satisfy Formula 1 and Formula 2.

An example way of considering a vapor pressure decreasing due to mixing of the fluid and the refrigerant will be described with reference to FIG. 9, when the fluid and the refrigerant have the compatibility relationship. FIG. 9 is a characteristic diagram showing an example of the compatibility between the incompressible fluid and the gas phase refrigerant filled in the expansion valve 301B. The incompressible fluid corresponds to oil, and FIG. 9 shows a relationship of vapor pressure ratio (P/Pr) (vertical axis) of the oil relative to a molecular fraction (horizontal axis) of the oil. Here, the characteristic of the vapor pressure decreasing of FIG. 9 is calculated based on Raoul's law (a vapor pressure of a component in a solution is represented by a multiplication of a vapor pressure of pure liquid of the component and a molecular fraction of the component to the solution) in an assumption that the solution is an ideal solution in which intermolecular forces are not applied between the components.

Further, in a case that the fluid and the refrigerant have the compatibility with each other, when resolving characteristics relative to each other determined based on the pressure and the temperature are known, the amounts and the pressures of the fluid and the refrigerant are controlled based on the characteristics.

Further, a surface tension raising member 372 may be arranged on the interface 356 between the fluid and the refrigerant so as to cross the tube space 355. FIG. 10 is a plan view of the surface tension raising member 372. As shown in FIG. 10, the surface tension raising member 372 is made of a bridging wire member or a grid-shaped member such as mesh or net, which crosses with the axis direction of the tube space 355. When the incompressible fluid contacts the surface tension raising member 372 at a position adjacent to the interface 356, a contacting area of the incompressible fluid becomes large in a passage cross-section area. Thus, because the surface tension is increased, the balance between the fluid and the refrigerant can be more stably maintained. The interface 356 can be stable, even when the fluid and the refrigerant are not separated by a special member. Further, when the surface tension raising member 372 is made of the grid-shaped member, a density of the mesh is required to be increased, and an open ratio of the grid-shaped member is required to be small, in a range not to restrict a flow of the fluid.

In contrast, the incompressible fluid and the gas phase refrigerant filled in the expansion valve 301A may have a relationship having no compatibility relative to each other. In this case, the fluid and the refrigerant are completely separated into two layers, and a balance of the two layers is maintained at the interface 356. Further, the considering of the vapor pressure decreasing to make the drag force larger than the gravity force is not needed, when a specification of the expansion valve 301B is designed. Thus, the expansion valve 301B can be easily produced.

Operations and advantages of the expansion valve 301B of the present embodiment will be described. The incompressible fluid is filled in an upper area of the tube space 355 including at least the upper chamber 355. A volume change of the incompressible fluid due to a pressure variation is small. The gas phase refrigerant is filled in an area located lower than the upper area. The fluid and the refrigerant have the compatibility relative to each other at the predetermined ratio. The expansion valve 301B is defined in a manner that the drag force caused by the surface tension to restrict the incompressible fluid from falling into the lower part of the tube space 355 becomes larger than the gravity force of the incompressible fluid applied to the interface 356.

Following advantages can be obtained due to the above construction. Due to the heat conductivity low layer 360, time constant of heat transmission can be made larger. The heat transmission is defined to transmit heat of refrigerant flowing through the outlet of the evaporator 306 to temperature sensing refrigerant (the gas refrigerant). Thus, time constant effective for restricting a hunting phenomenon can be easily secured.

Further, the fluid and the refrigerant have the compatibility relative to each other at the predetermined ratio. The expansion valve 301B is defined by considering the resolving characteristics with each other (compatibility) in a manner that the drag force caused by the surface tension becomes larger than the gravity force of the incompressible fluid. Therefore, the fluid and the refrigerant form two layers in which a predetermined amount of the fluid and a predetermined amount of the refrigerant resolve with each other, and a balance of the two layers is maintained at the interface 356. Thus, the interface 356 can be stable without a special portion to separate the fluid and the refrigerant.

Further, a volume variation generated by a pressure variation is small in the incompressible fluid filled in the upper space. Therefore, a volume variation generated by an atmospheric temperature variation is small. The interface 356 between the incompressible fluid and the gas phase refrigerant has a displacement amount cause by the volume change. The displacement amount generated by the volume change is sufficiently smaller than that generated by a displacement of the diaphragm 332. The upper chamber 335 is easily affected by atmospheric temperature variation. However, the volume change of the incompressible fluid filled in the upper chamber 335 is small, such that disadvantage of malfunction can be eliminated. The malfunction is generated by a condensing of temperature sensing fluid at an upper part of the power element 330 at a low temperature time, in a comparison example. Thus, the gas-charged expansion valve can have better productivity, and influence of the atmospheric temperature variation can be reduced relative to the expansion valve.

Further, a gas-charged expansion valve can be provided, in which the gas phase refrigerant is filled in the lower space located lower than the upper space including at least the upper chamber 335. Cost and man-hour for producing the gas-charged expansion valve 301B are lower than those for producing a liquid-charged or adsorbent-charged expansion valve. Thus, the productivity can be improved.

Seventh Embodiment

Figure 11:
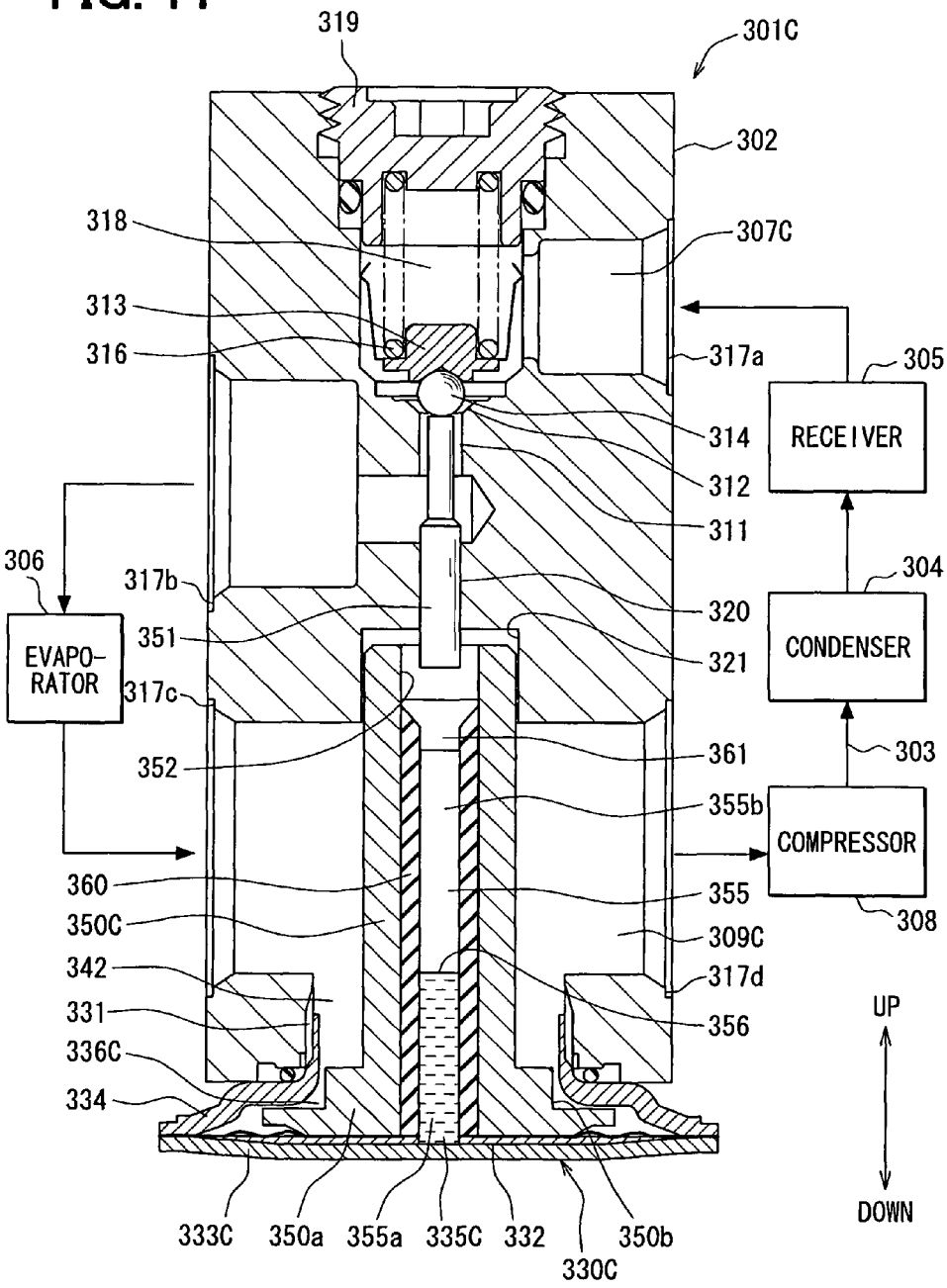
FIG. 11 is a cross-sectional view illustrating an expansion valve according to a seventh embodiment.

An expansion valve 301C of a seventh embodiment will be described with reference to FIG. 11. FIG. 11 shows a longitudinal cross-sectional view of the expansion valve 301C of the seventh embodiment. A member of FIG. 11 having the same reference number as the fifth embodiment is the same member having the same functions and advantages.

As shown in FIG. 11, the expansion valve 301C of the present embodiment is different from the expansion valve 301, 301A in a point not having the piston 370 or the shape-changeable member 371 separating a space. Further, the first space 355*a* is located lower than the second space 355*b*. That is, the expansion valve 301C is different from the expansion valve 301, 301A, 301B in a direction of arranging the valve in the up-and-down direction. The expansion valve 301C is defined to make an upside of the expansion valve 301B down. Thus, the first passage 307C is located on the upper side, and the second passage 309C is located on the lower side.

The expansion valve 301C has the following construction due to the change of locating direction. The incompressible fluid is located on the lower side, and the gas phase refrigerant is located on an upper side of the incompressible fluid. A first end of a temperature sensing bar 350C contacts with a diaphragm 332 located on the lower side, and a second end of the sensing bar 350C is arranged to drive a valve portion 314 through an operation bar 351. The operation bar 351 directly contacts with the valve portion 314, and is supported by a cover 361 fixed on an upper end of the sensing bar 350C. The cover 361 covers the upper end of the sensing bar 350C, and seals an upper part of the tube space 355. A power element 330C of the expansion valve 301C includes a board-shaped first cover 333C located on the lower side, and a second cover 334 located on the upper side. The diaphragm 332 is supported between the covers 333C, 334.

Next, a process of filling the fluid and the refrigerant into the tube space 355 of the expansion valve 301C will be described. The diaphragm 332 is supported in the power element 330C and the sensing bar 350C is mounted in the power element 330C. Relative to the power element 330C, the incompressible fluid is filled in a first pressure-responding chamber 335C through an opening 352 defined in an upper end of the sensing bar 350C. Next, the gas phase refrigerant is filled through the opening 352, and the opening 352 is sealed by the cover 361. Thus, the fluid and the refrigerant are filled in the tube space 355 so as to form two layers.

The power element 330C is mounted in a screw hole 331 of a body portion 302 by tightening. The integrated covers 333C, 334 are mounted to the body portion 302, thereby a first pressure-responding chamber 335C and a second press-responding chamber 336C are defined in the power element 330C through the diaphragm 332. The first chamber 335C is located on the lower side, and the second chamber 336C is located on the upper side. At the same time, a lower end of the operation bar 351 is supported by the cover 361, and a displacement of the sensing bar 350C is transmitted to the valve portion 314 through the operation bar 351.

The expansion valve 301C has the above described posture arrangement, and includes the cover 361. Therefore, the sealing plug 340 included in the expansion valve 301, 301A, 301B is not included in the expansion valve 301C. Thus, the number of parts and the number of assembling processes of the power element 330C can be reduced.

The expansion valve 301C of the present embodiment is configured to make the first space 355*a* filled with the incompressible fluid to be located lower than the second space 355*b* filled with the gas phase refrigerant. According to the construction, because the incompressible fluid is located lower than the gas phase refrigerant, the gas phase refrigerant can be filled in the second space 355*b* after the incompressible fluid is filled in the first space 355*a* of the power element 330. Further, the power element 330C including the fluid and the refrigerant, and the temperature sensing bar 350C can be mounted to a predetermined position of the body portion 302. Thus, a sealing member needed for filling the fluid is not needed for the power element of the present embodiment. Therefore, a construction of the power element can be simplified.

Eighth Embodiment

Figure 12:
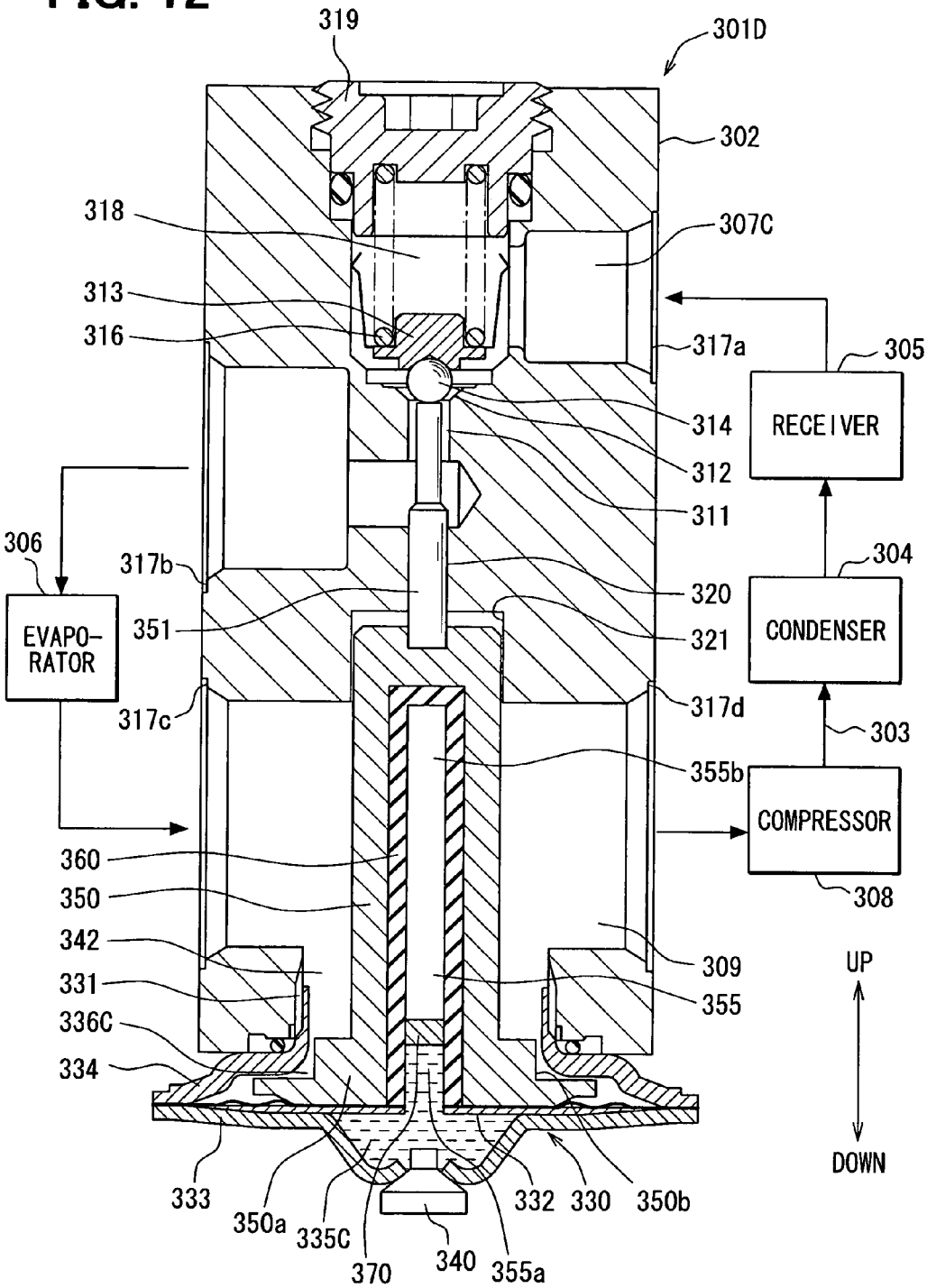
FIG. 12 is a cross-sectional view illustrating an expansion valve according to an eighth embodiment.

An expansion valve 301D of an eighth embodiment will be described with reference to FIG. 12. FIG. 12 shows a longitudinal cross-sectional view of the expansion valve 301D of the eighth embodiment. A member of FIG. 12 having the same reference number as the fifth embodiment is the same member having the same functions and advantages.

As shown in FIG. 12, the expansion valve 301D is different from the expansion valve 301 of the fifth embodiment in an arranging direction. That is, an upside of the expansion valve 301 is made down in the expansion valve 301D. A first space 355*a* filled with the incompressible fluid can be located lower than a second space 355*b* filled with the gas phase refrigerant. The fluid typically has a specific gravity larger than that of the refrigerant, and the fluid can be placed on the lower side. A piston 370 of the expansion valve 301D may be changed with a shape-changeable member 371.

Other Embodiments

The fluorocarbon refrigerant R134a is used in the above embodiments. Alternatively, R410A, R404A, R152a, R744 or R600a may be used as the refrigerant. Further, one of the above refrigerants may be used as the temperature sensing media.

Ethanol ($C_2H_6O$) or silicon oil is used as the additive in the above embodiments. Alternatively, other alcohol such as methanol or propanol may be used as the additive, or other compressor oil used for the refrigeration cycle may be used as the additive.

The diaphragm 53*b* is made of stainless steel (SUS304) in the above embodiments. Alternatively, the diaphragm 53*b* may be made of other metal such as brass.

The heat insulation member 60 is made of polyoxymethylene (POM) in the above embodiments. Alternatively, the heat insulation member 60 may be made of other resin such as polyphenylene sulfide (PPS).

The ballast member 71 is made of ceramics such as alumina silica in the above embodiments. Alternatively, the ballast member 71 may be made of granular activated carbon having a heat capacity larger than that of the temperature sensing bar 52*b*.

The heat insulation member 60 is mounted around the inner wall face of the column space 10, and the ballast member 71 is filled in the heat insulation member 60, in the above embodiments. Alternatively, the ballast member 71 may be directly filled in the column space 10 without the heat insulation member 60.

A volume change of the incompressible fluid generated by a pressure change is small. However, in a case that a predetermined compressing ratio is known in advance relative to a pressure generated by gas refrigerant filled in the second space 355*b*, fluid having the predetermined compressing ratio may be filled in the first space 355*a*. In this case, amounts and pressures of the gas refrigerant and the fluid are controlled in consideration of the compressing ratio.

Such changes and modifications are to be understood as being within the scope of the present invention as defined by the appended claims.

What is claimed is:

1. A thermal expansion valve used in a vapor compressing refrigeration cycle so as to decompress and expand high-pressure refrigerant and to send the expanded low-pressure refrigerant toward an inlet of an evaporator, the thermal expansion valve comprising:

a body portion having a first refrigerant passage through which the high-pressure refrigerant passes, a throttle passage located in the first refrigerant passage so as to decompress and expand refrigerant, and a second refrigerant passage through which refrigerant flowing out of the evaporator passes;

an element portion arranged outside of the body portion, the element portion having a pressure responding member to be displaced in accordance with a pressure difference between an inner pressure of a seal space and a pressure of refrigerant flowing through the second refrigerant passage, the seal space being sealed and filled with a temperature sensing media, the media having a pressure changed by a temperature variation;

a valve portion to be displaced in accordance with a displacement of the pressure responding member so as to control an opening degree of the throttle passage; and an additive filled in the seal space together with the temperature sensing media so as to lower a condensing temperature of the temperature sensing media;

wherein the temperature sensing media has a gas phase in the seal space and the additive has a liquid phase in the seal space.

2. The thermal expansion valve according to claim 1, wherein the element portion is configured to be formed by filling a predetermined amount of the additive having a liquid phase into the seal space filled with gas having a temperature and a pressure defined to make the additive to have the liquid phase, by vacuuming the gas from the seal space, and by filling a predetermined amount of the temperature sensing media into the seal space.

3. The thermal expansion valve according to claim 1, wherein the element portion is configured to be formed by filling a predetermined amount of the additive having a liquid phase into the seal space filled with the temperature sensing media having a gas phase and having a temperature and a pressure so as to make the additive to have the liquid phase, and by filling a predetermined amount of the temperature sensing media into the seal space.

4. The thermal expansion valve according to claim 1, wherein the element portion is configured to be formed by vacuuming gas from the seal space, by filling a predetermined amount of the temperature sensing media having a gas phase into the vacuumed seal space, and by filling a predetermined amount of the additive having a liquid phase into the vacuumed seal space.

5. The thermal expansion valve according to claim 1, wherein the temperature sensing media and the additive have a relationship of $0.80 \geq Ma/(Ma+Mr)$, when the media is set to have a predetermined amount Mr (unit: mole), and when the additive is set to have a predetermined amount Ma (unit: mole).

6. The thermal expansion valve according to claim 1, further comprising:

an additive retainer to retain the additive.

7. The thermal expansion valve according to claim 1, further comprising:

a temperature sensing bar to transmit the displacement of the pressure responding member to the valve portion, and to transmit a temperature of refrigerant passing through the second refrigerant passage to the temperature sensing media, wherein the temperature sensing bar has a column space extending in an axis direction inside of the temperature sensing bar and communicating with the seal space, and the column space accommodates a thermal ballast member made of a material having a heat capacity higher than that of the temperature sensing bar.

8. The thermal expansion valve according to claim 1, further comprising:

a temperature sensing bar to transmit the displacement of the pressure reacting member to the valve portion, and to transmit a temperature of refrigerant passing through the second refrigerant passage to the temperature sensing media, wherein the temperature sensing bar has a column space extending in an axis direction inside of the temperature sensing bar and communicating with the seal space, and the column space accommodates a low heat-conductivity member made of a material having a heat conductivity lower than that of the temperature sensing bar.

9. The thermal expansion valve according to claim 1, further comprising:

a temperature sensing bar to transmit the displacement of the pressure reacting member to the valve portion, and to transmit a temperature of refrigerant passing through the second refrigerant passage to the temperature sensing media, wherein the temperature sensing bar has a column space extending in an axis direction inside of the temperature sensing bar and communicating with the seal space, the column space is defined to have an upper part located adjacent to the pressure responding member and a lower part located adjacent to the valve portion, and the lower part has an inner diameter smaller than that of the upper part, in a cross-section of the column space in the axis direction.

10. The thermal expansion valve according to claim 1, wherein the temperature sensing media is refrigerant circulating in the vapor compressing refrigeration cycle.

11. The thermal expansion valve according to claim 1, wherein the condensing temperature of the temperature sensing media is lower than that of refrigerant circulating in the vapor compressing refrigeration cycle, due to the additive.

12. The thermal expansion valve according to claim 1, wherein the additive is a material which is able to have a phase change between gas and liquid.

13. The thermal expansion valve according to claim 1, wherein the additive is ethanol.

14. The thermal expansion valve according to claim 1, wherein the temperature sensing media has a vapor pressure decreasing which is proportional to a concentration of the additive relative to the temperature sensing media.

15. The thermal expansion valve according to claim 1, wherein the additive has a phase change between gas and liquid phases within the sealed space.

16. The thermal expansion valve according to claim 1, wherein an amount of the additive is determined by using Raoult's Law.

17. The thermal expansion valve according to claim 1, wherein a solution of the temperature sensing media and the additive has a lower condensing temperature of the temperature sensing media alone.

18. A thermal expansion valve used in a vapor compressing refrigeration cycle so as to decompress and expand high-pressure refrigerant and to send the expanded low-pressure refrigerant toward an inlet of an evaporator, the thermal expansion valve comprising:

a body portion having a first refrigerant passage through which the high-pressure refrigerant passes, a throttle passage located in the first refrigerant passage so as to decompress and expand refrigerant, and a second refrigerant passage through which refrigerant flowing out of the evaporator passes;

an element portion arranged outside of the body portion, the element portion having a pressure responding member to be displaced in accordance with a pressure difference between an inner pressure of a seal space and a pressure of refrigerant flowing through the second refrigerant passage, the seal space being sealed and filled with a temperature sensing media, the media having a pressure changed by a temperature variation;

a valve portion to be displaced in accordance with a displacement of the pressure responding member so as to control an opening degree of the throttle passage; and an additive filled in the seal space together with the temperature sensing media to form a solution, the solution having a condensing temperature lower than a condensing temperature of the temperature sensing media;

wherein the temperature sensing media has a gas phase in the seal space and the additive has a liquid phase in the seal space.

19. The thermal expansion valve according to claim 18, wherein the additive dissolves in the temperature sensing media.

* * * * *